US010869808B2

(12) United States Patent
Fung et al.

(10) Patent No.: US 10,869,808 B2
(45) Date of Patent: Dec. 22, 2020

(54) SYSTEM AND METHOD FOR SEXUAL STIMULATION

(71) Applicant: Crave Innovations, Inc., San Francisco, CA (US)

(72) Inventors: Calvin Fung, San Francisco, CA (US); Tad Masek, San Francisco, CA (US); Michael Topolovac, San Francisco, CA (US); Christine Concho, San Francisco, CA (US); Tian Yi Chang, San Francisco, CA (US)

(73) Assignee: Crave Innovations, Inc., San Francisco, CA (US)

( * ) Notice: Subject to any disclaimer, the term of this patent is extended or adjusted under 35 U.S.C. 154(b) by 496 days.

(21) Appl. No.: 15/843,240

(22) Filed: Dec. 15, 2017

(65) Prior Publication Data

US 2018/0168919 A1 Jun. 21, 2018

Related U.S. Application Data

(60) Provisional application No. 62/434,713, filed on Dec. 15, 2016.

(51) Int. Cl.

| | |
|---|---|
| ***A61H 19/00*** | (2006.01) |
| ***A61H 23/02*** | (2006.01) |
| *A61H 9/00* | (2006.01) |

(52) U.S. Cl.

CPC ..... *A61H 19/30* (2013.01); *A61H 23/02* (2013.01); *A61H 9/0078* (2013.01); *A61H 19/44* (2013.01); *A61H 23/0218* (2013.01); *A61H 23/0263* (2013.01); *A61H 2201/0153* (2013.01); *A61H 2201/0207* (2013.01); *A61H 2201/0228* (2013.01); *A61H 2201/0285* (2013.01); *A61H 2201/501* (2013.01); *A61H 2201/5002* (2013.01); *A61H 2201/5023* (2013.01);

(Continued)

(58) Field of Classification Search

CPC ..... A61H 19/00; A61H 19/30; A61H 19/32; A61H 19/34; A61H 19/40; A61H 19/44; A61H 19/50; A61H 23/02; A61H 2201/5064; A61H 2201/5002; A61H 2201/50; A61H 2201/501; A61H 2201/0153

USPC ..... 600/38; 601/46

See application file for complete search history.

(56) References Cited

U.S. PATENT DOCUMENTS

| | | | |
|---|---|---|---|
| 8,766,784 | B2 | 7/2014 | Radivojevic et al. |
| 8,936,544 | B2 | 1/2015 | Shahoian et al. |

(Continued)

OTHER PUBLICATIONS

Dejan Nedelkovski, "MEMS Accelerometer Gyroscope Magnetometer & Arduino", Nov. 19, 2015, How to Mechatronics (Year: 2015).*

*Primary Examiner* — Bradley H Philips
*Assistant Examiner* — Savannah L Gabriel
(74) *Attorney, Agent, or Firm* — Jeffrey Schox; Diana Lin

(57) ABSTRACT

An excitation device, preferably including: stimulation units; a sensor; a processor configured to control the stimulation units; a power module configured to power excitation device components; and a housing configured to house the other excitation device components and to couple the excitation device to a user. A control device, preferably including one or more outputs and a housing. A method for sexual stimulation, preferably including: sampling measurements, determining actuation parameters, and actuating stimulation units.

18 Claims, 18 Drawing Sheets

(52) U.S. Cl.
CPC ..... *A61H 2201/5048* (2013.01); *A61H 2201/5058* (2013.01)

(56) References Cited

U.S. PATENT DOCUMENTS

2011/0034837 A1* 2/2011 Lee ..... A61H 23/02 601/46
2013/0331745 A1* 12/2013 Sedic ..... A61H 23/00 601/46

* cited by examiner

SYSTEM AND METHOD FOR SEXUAL STIMULATION

CROSS-REFERENCE TO RELATED APPLICATIONS

This application claims the benefit of U.S. Provisional Application Ser. No. 62/434,713, filed on 15 Dec. 2016, which is incorporated in its entirety by this reference.

TECHNICAL FIELD

This invention relates generally to the sexual stimulation field, and more specifically to new and useful excitation and actuation devices and/or methods of use in the sexual stimulation field.

DESCRIPTION OF THE PREFERRED EMBODIMENTS

The following description of the preferred embodiments of the invention is not intended to limit the invention to these preferred embodiments, but rather to enable any person skilled in the art to make and use this invention.

1. Overview.

Figure 1A:
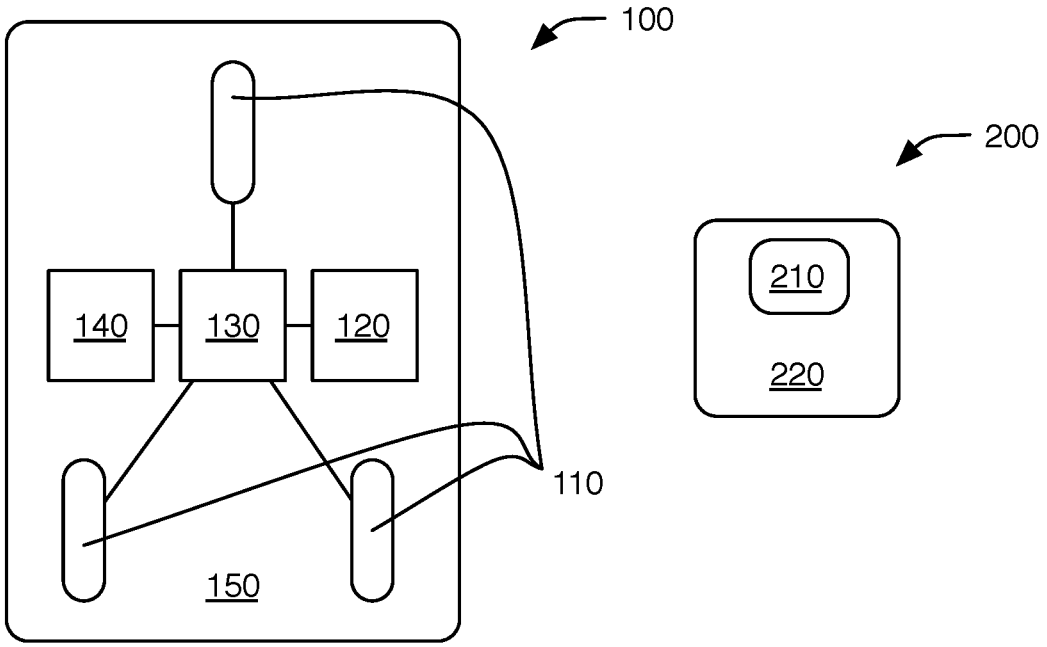
FIGS. 1A and 1B are schematic representations of a variation of the system and a variation of the excitation device, respectively.

The system 1 functions to stimulate a user and to enable intuitive control of the stimulation. As shown in FIG. 1A, the system 1 includes an excitation device 100. The system can optionally include a control device 200 that can be used with the excitation device 100, wherein the excitation device 100 is operable based on control device 200 parameters.

Figure 1B:
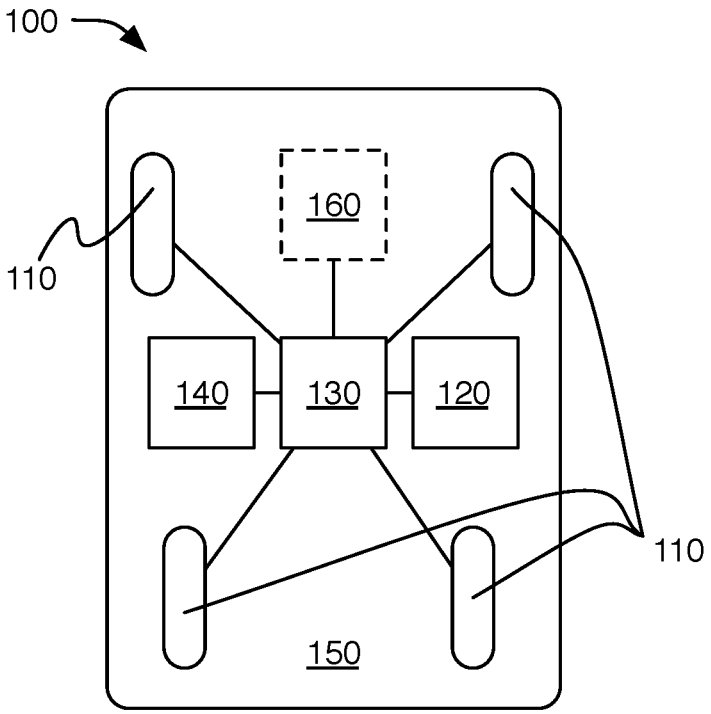

The excitation device 100 preferably functions as a sex toy and can be used to stimulate an erogenous zone and/or other body part of a user. As shown in FIG. 1B, the excitation device 100 preferably includes: a plurality of individually controllable stimulation units 110; a sensor 120 (e.g., configured to sample a parameter of the control device 200); a processor 130 configured to individually control each of the plurality of stimulation units 110 (e.g., based on the parameter value of the control device 200 sampled by the sensor 120); a power module 140 configured to power excitation device components, such as the stimulation units 110, sensor 120, and/or processor 130; and a housing 150 configured to house the other excitation device components and to couple the excitation device 100 to a user; and can additionally include a communication module 160 and/or any other suitable components. The excitation device 100 is preferably configured to be used with one or more control devices 200, wherein the excitation device 100 is operable based on control device parameters.

The control device 200 preferably functions as an intuitive controller for the excitation device 100. The control device 200 preferably includes one or more outputs 210 and a housing 220, and can additionally or alternatively include a sensor, power module, processor, communication module (e.g., configured to communicate with the excitation device, with an external device, etc.), and/or any other suitable elements.

In one example, the control device includes an electromagnetic element (e.g., permanent magnet, electromagnet, etc.), and the excitation device 100 includes a plurality of stimulation units 110 and one or more magnetometers, all statically mounted to a housing 150 of the excitation device 100. In this example, the stimulation units 110 are each individually operated based on their proximity to the control device, wherein the control device position relative to the excitation device 100 (and/or information associated with the position, such as the direction, distance, etc.) is determined (e.g., estimated, calculated, etc.) based on the magnetic signal sampled by the magnetometer(s). In a specific example, the stimulation units no include haptic outputs (e.g., vibratory actuators), wherein the haptic outputs determined to be closest to the control device 200 are operated at a higher intensity than haptic outputs determined to be furthest from the control device 200. In this specific example, the magnetic signals are re-sampled at a predetermined frequency, such that the most intense haptic output substantially follows the control device position (e.g., in real- or near-real time; with delay less than a threshold time, such as 1 ms, 10 ms, 100 ms, or 300 ms; after a predetermined delay, such as 1 s, 5 s, 10 s, 1 min, 1 hour, or 1 day; etc.). However, the excitation device 100 and control device 200 can operate (together and/or separately) in any suitable manner.

2. Excitation Device.

2.1 Stimulation Units.

The excitation device 100 preferably includes a plurality of stimulation units 110. The stimulation units 110 function to stimulate the user, preferably by stimulating a soft tissue of the user.

Each stimulation unit 110 is preferably powered by independent power signals and configured to actuate independently from the other stimulation units 110. Alternatively, a group of stimulation units 110 (e.g., a cluster or subset of the stimulation units no) can be independently controlled, such that the group of stimulation units 110 can operate independently from the other stimulation units 110. Each controlled subset (e.g., individual stimulation unit 110 or cluster) can include one or more stimulation units 110 of the same or different types.

Each controlled subset is preferably individually identified, such that it has a locally unique identifier (e.g., index value), but can alternatively share an identifier with a second controlled subset of the excitation device 100, or be otherwise identified. Each controlled subset (or the respective identifier) is preferably associated with a known, stored spatial position on the excitation device 100 (controlled subset position). The controlled subset position can include an arcuate position, radial position, position along an axis (e.g., lateral axis, longitudinal axis, etc.), set of coordinates, grid position, position relative to another excitation device component (e.g., sensor 120, different stimulation unit 110, etc.), or be any other suitable position. The controlled subset positions are preferably stored by the excitation device 100 (e.g., on volatile or non-volatile memory), but can alternatively or additionally be stored by the control device 200, remote system, external device, or by any other suitable system.

Each controlled subset is preferably wired in parallel relative to other controlled subsets of the excitation device 100, but can alternatively be wired in series, wired in a combination of in parallel and in series, or be wired in any other suitable manner. The controlled subsets of the excitation device 100 are preferably controlled by the processor 130, but can additionally or alternatively be controlled by the control device 200 and/or by a remote computing system (e.g., server system), external device (e.g., mobile device, appliance, etc.), or any other computing system.

Each stimulation unit no preferably includes a vibratory element that generates vibratory stimulation through an electromechanical actuator, such as an electric motor coupled to a counterweight, a piezoelectric transducer coupled to a mass, a charged diaphragm coupled to a mass, a magnetic vibrator, or any other linear or rotary actuator manipulating an (eccentric) mass to generate a vibration. Furthermore, the counterweight or mass can include a bladder system with a hydraulic or pneumatic cavity configured to fill and drain to adjust the vibratory output or "feel" of the vibratory actuator. However, the stimulation units no can additionally or alternatively include any one or more of a heating element, a cooling element, a suction element, a pump, a fan, a linear or non-linear actuator, a bladder, a phase change material, a shape memory material (e.g., Nitinol), a set of electrodes to output electrical shocks or pulses to a portion of the body of the user, lights or a display to output visual cues, a smell module to provide olfactory sensations, a speaker or other audio generator, or any other suitable stimulatory unit, element, or component. The excitation device 100 can include one or more stimulation units 110 of the same or different types.

In example implementations, the excitation device 100 can include: three (or more) vibratory actuators; a vibratory actuator and a heating element; two vibratory actuators and an infrared emitter; or three electrical shock units and a suction element. However, the interaction module no can include any other suitable stimulation units 110.

The stimulation units 110 are preferably configured to stimulate one or more body parts, preferably including external female sex organs, such as the clitoris, labia, vulva, perineum, anus, nipple, breast, or areola, but additionally or alternatively including: male sex organs, such as the penis, scrotum, perineum, or anus; internal sex organs, such as the vagina, G-spot, prostate, rectum; and/or any other internal or external portion of the body of a female or male user, such as the neck, ear, arm, thigh, foot, kneecap, hand, elbow, armpit, or cheek.

The stimulation units 110 are preferably arranged such that when the excitation device 100 is used, the stimulation units no are in contact with or close to the body part they are configured to stimulate (target body part). The stimulation units 110 are preferably arranged in different regions on and/or around the target body part, such that the user can discern between individual actuation of each unit, but can alternatively form a continuous or pseudo-continuous output surface or region or produce substantially indistinguishable outputs. The stimulation units no are preferably arranged based on the target body part type (e.g., following the shape of the target body part, accounting for features of the target body part, etc.), but additionally or alternatively can have a generic arrangement or an arrangement suitable for multiple different target body parts. The stimulation units 110 can be arranged along a linear, arcuate, polygonal, or circular path; in an array; in, alongside, or partially or wholly surrounding a region configured to contact a target body part; substantially evenly distributed about an excitation device perimeter; substantially evenly distributed across an excitation device area; unevenly distributed across the excitation device or portion thereof; or can have any other suitable arrangement.

The stimulation units 110 are preferably statically mounted to the housing 150 (e.g., wherein their position relative to other excitation device components is fixed and known), but can additionally or alternatively be movably mounted to the housing 150 (e.g., wherein their position can be estimated, measured, determined based on image analysis, provided by a user such as through a user device client, etc.) or connected in any other suitable way. The stimulation units 110 can be adhered to the housing 150, press-fit into the housing 150, encapsulated within the housing 150, fastened to the housing 150, or attached in any other suitable way. The stimulation units 110 can be inside the housing 150, on the surface of the housing 150, on the perimeter of the housing 150, or in or on any other suitable portion of the housing 150.

Figure 2:
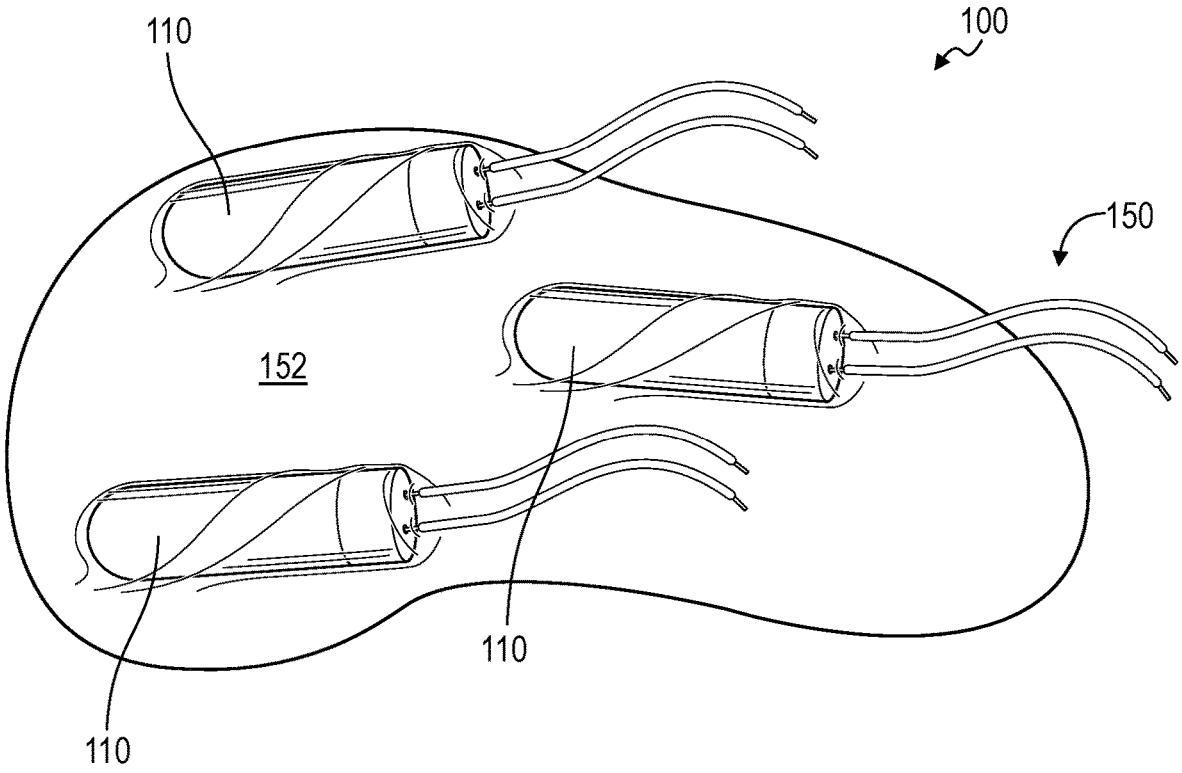
FIG. 2 is a perspective view of the housing and stimulation units of a first example of the excitation device.
Figure 3A:
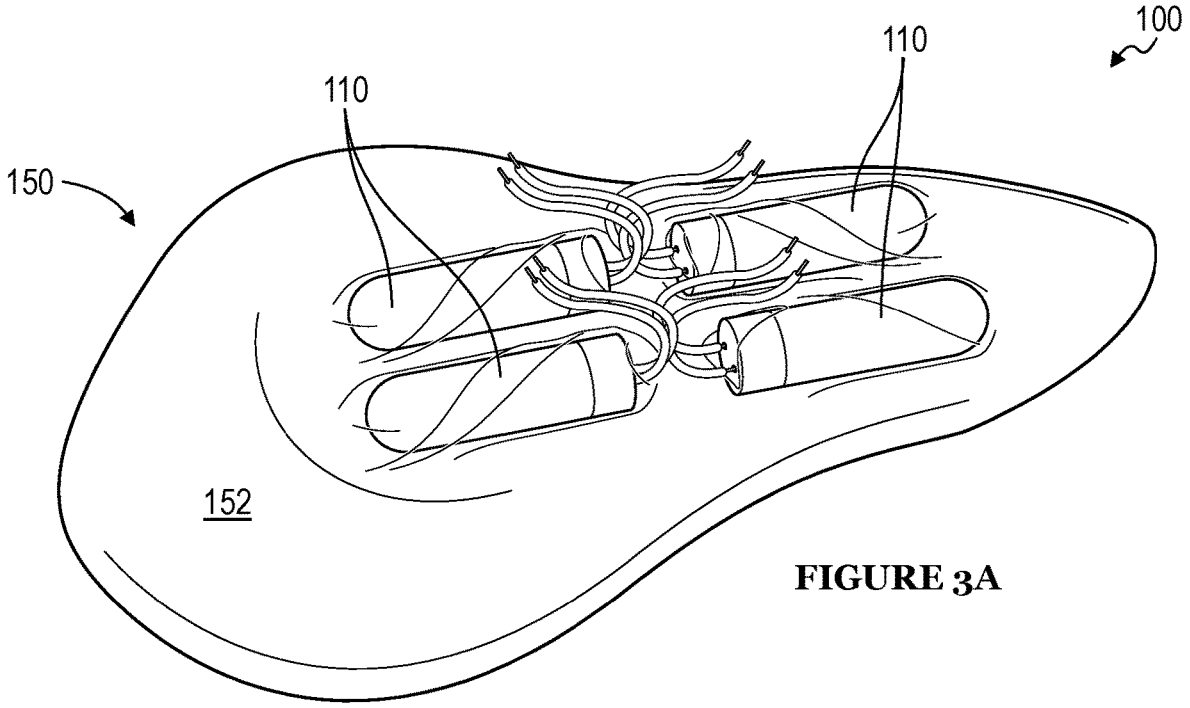
FIGS. 3A and 3B are perspective views of the housing and stimulation units of a second example of the excitation device.
Figure 3B:
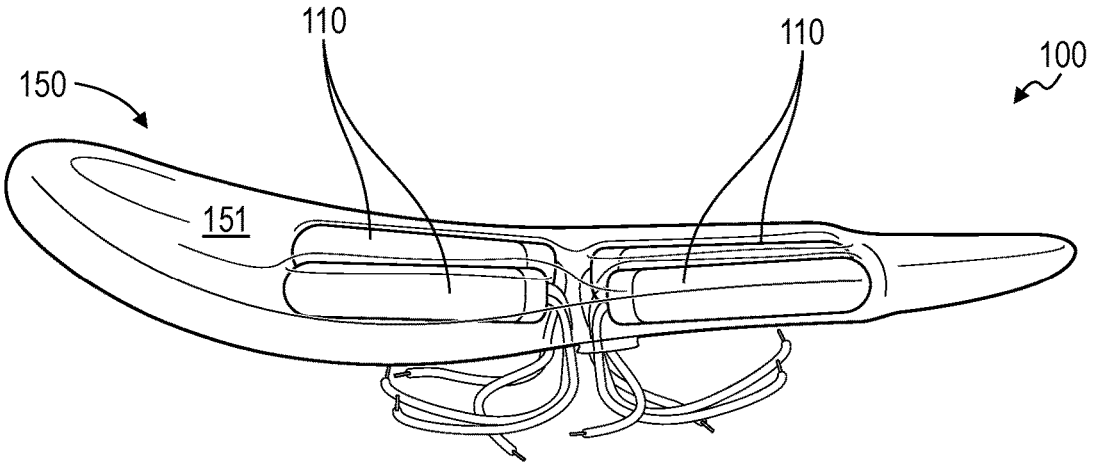

In a first variation, the stimulation units no (e.g., vibratory elements, heating elements, suction elements, etc.) are configured to stimulate a vulva (e.g., as shown in FIGS. 2 and 3A-B). In a first example of this variation, the stimulation units 110 are arranged along multiple lines or arcs, positioned along the labia when the excitation device 100 is worn. In a second example of this variation, one or more stimulation units 110 are positioned near the clitoris when the device is worn, and one or more additional stimulation units no are positioned elsewhere on or around the vulva. In a specific example of this example, three vibratory elements are arranged substantially along a line, such that the middle vibratory element is positioned near the clitoris and the other two are positioned to the right and left of the clitoris, respectively. In a third example, a suction element is positioned near the clitoris (e.g., configured to envelop and/or generate a suction force on all or part of the clitoris).

Figure 4A:
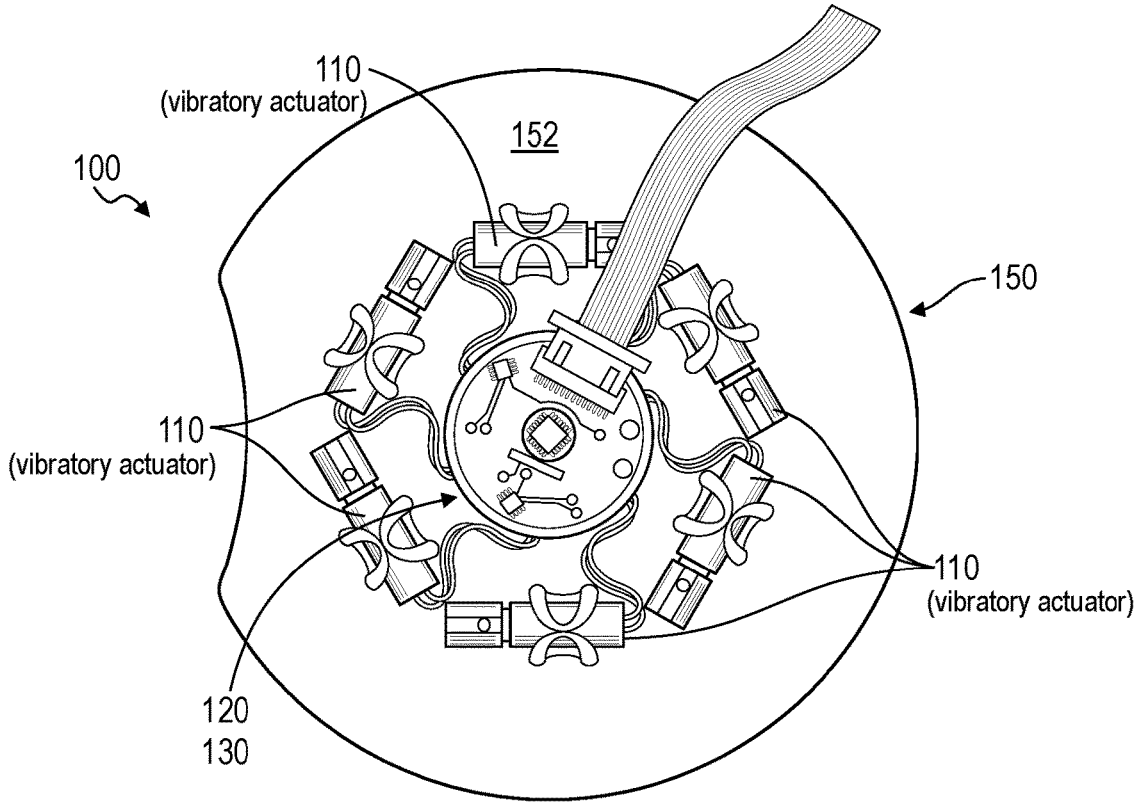
FIGS. 4A and 4B are an overhead view and a perspective view of a third example of the excitation device.
Figure 4B:
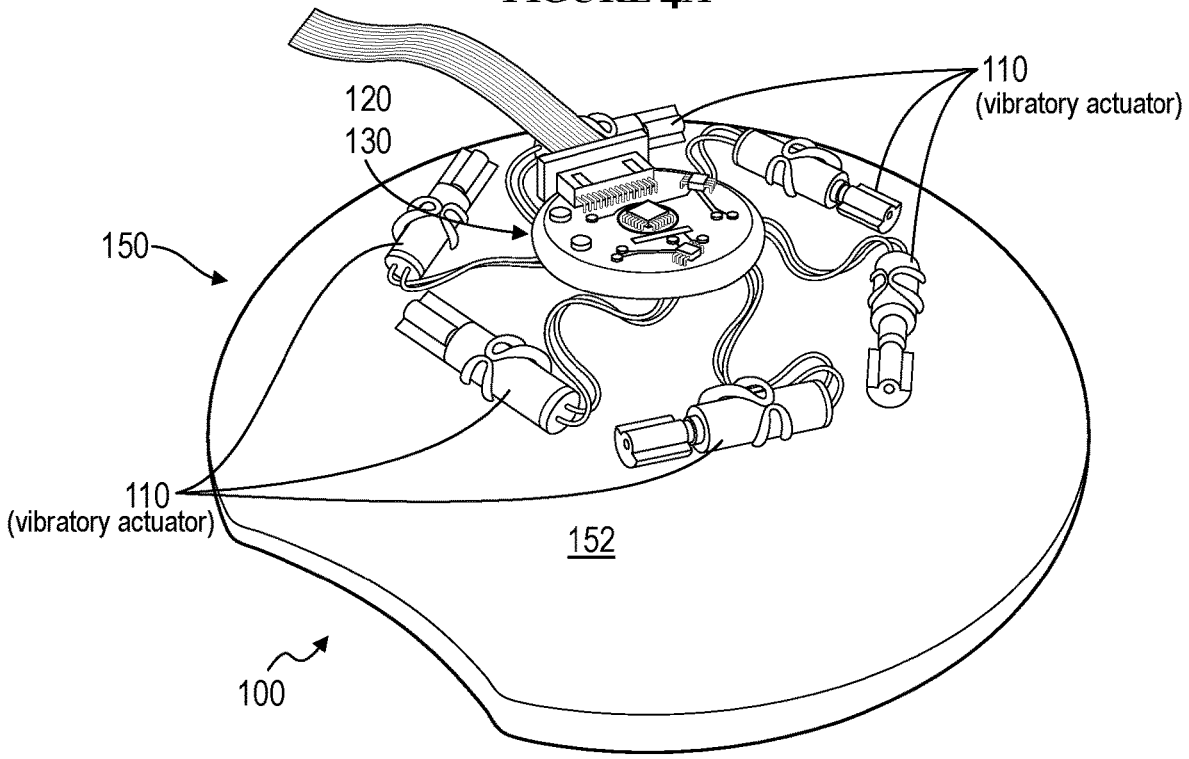

In a second variation, the stimulation units 110 are configured to stimulate a breast (e.g., as shown in FIGS. 4A-B). In a first example of this variation, the stimulation units 110 surround a central region of the excitation device 100, such that the stimulation units 110 surround a nipple or areola of the user when the excitation device 100 is worn. In a second example of this variation, the stimulation units 110 are arranged along a line or arc, positioned along one or more sides of the breast (e.g., medial side, lateral side, underside) when the excitation device 100 is worn.

Figure 5A:
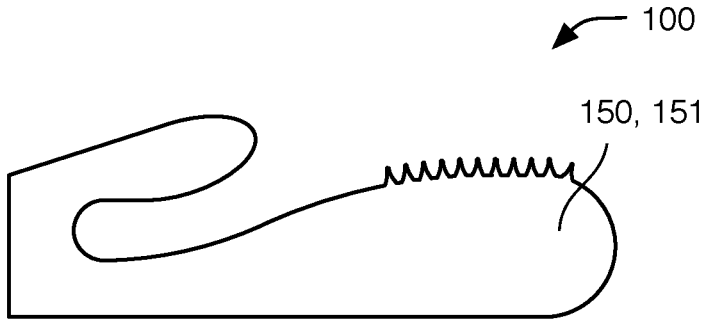
FIGS. 5A and 5B are a side view and a cross-sectional view of a fourth example of the excitation device.
Figure 5B:
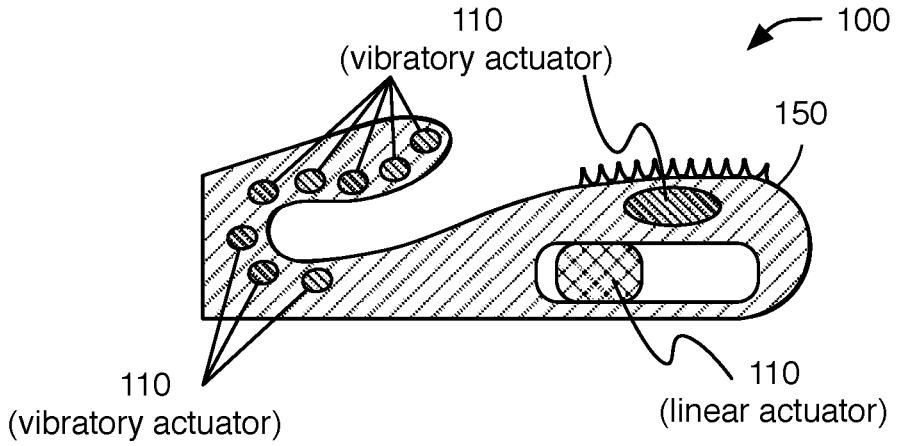

In a third variation, the stimulation units 110 are configured to stimulate a vagina into which the excitation device 100 is inserted (e.g., as shown in FIGS. 5A-B). In a first example of this variation, a linear and/or rotary actuator is configured to move within the vagina, and additional stimulation units 110 are configured to stimulate a clitoris, perineum, anus, and/or other body part near the vagina. However, the stimulation units 110 can be arranged in any suitable geometry and configured to stimulate any suitable body part(s).

2.2 Sensor.

The excitation device 100 preferably includes one or more sensors 120. The sensor 120 functions to sample one or more signals, such as signals associated with the control device 200, which can be used to determine one or more control device parameters and/or other control parameters.

The control device parameters can be a control device relative position (e.g., lateral position, arcuate position, distance along an axis, total distance, etc.; relative to the sensor 120, stimulation units 110, external reference point, etc.), absolute position, orientation (e.g., with respect to the excitation device 100 position and/or orientation, with respect to gravity, etc.), signal magnitude, traversed path or pattern, and/or any other suitable parameter. Other control parameters can include user gestures (e.g., hand, arm, and/or body positions and/or movements), sounds (e.g., clapping, voice commands, sound intensity, sound source direction, etc.), and/or any other suitable control parameters.

The signals are preferably magnetic signals (e.g., characterized by a magnetic field strength, orientation, and/or other parameter), but can additionally or alternatively be electrical signals, electromagnetic signals (e.g., optical signals, radio signals, microwave signals, etc.), acoustic signals, force signals, temperature signals, and/or any other suitable signals. Accordingly, the sensor 120 is preferably a magnetometer (e.g., vector magnetometer such as a Hall effect sensor, fluxgate magnetometer, or magnetoresistive sensor; scalar magnetometer), more preferably a three-axis magnetometer. Additionally or alternatively, the sensor 120 can be an electrical sensor, optical sensor (e.g., camera, ambient light sensor, optical proximity sensor, laser rangefinder, etc.), radio receiver, radar or lidar sensor, acoustic sensor (e.g., directional sensor array, omnidirectional microphone, etc.), ultrasonic sensor, distance sensor (e.g., rangefinder, such as a time-of-flight sensor), touch sensor (e.g., capacitive or resistive), pressure or stress sensor, temperature sensor (e.g., thermometer, multimetal sensor such as a bimetallic strip, thermocouple, thermistor, optical thermometer such as an IR sensor, etc.), accelerometer, gyroscope, position sensor (e.g., GPS), and/or any other suitable sensor. The sensor can preferably sample instantaneous signals, preferably providing them to the processor 130 (e.g., in near real-time), and can additionally or alternatively sample signal patterns and/or changes in signals over time (e.g., velocity, acceleration, signal source movement, etc.).

The sensor 120 can have a fixed position relative to the stimulation units 110, a flexible position relative to the stimulation units 110 (e.g., wherein the sensor 120 and stimulation units 110 are connected by a flexible housing), a moveable position relative to the stimulation units 110 (e.g., wherein the relative position is estimated, measured by the sensor 120, or otherwise determined; wherein the relative position is unknown), or any other suitable position. For example, the sensor 120 can be near a stimulation unit 110 or centered within a group of stimulation units 110. The sensor 120 can be adhered to the housing 150, press-fit into the housing 150, encapsulated within the housing 150, fastened to the housing 150, or attached in any other suitable way. The excitation device 100 can include multiple sensors 120 (of the same or different types), preferably individually indexed and addressable, which can be arranged to enable superior detection of the control device parameters. For example, each sensor 120 can be arranged near a stimulation unit 110 (e.g., in sensor—stimulation unit pairs, wherein each stimulation unit 110 or controlled subset is associated with a nearby sensor 120), multiple sensors 120 can surround a stimulation unit 110 or group or array of stimulation units 110, sensors 120 can be distributed across a plane (e.g., stimulation unit array plane), across multiple planes (e.g., parallel planes), and/or throughout a volume. In a specific example, multiple magnetic field sensors (e.g., one or more 3-axis sensors, preferably supplemented by one or more 1-axis sensors) can be distributed over a space (e.g., throughout the excitation device). This can enable, for example, determination (e.g., based on trilateration and/or triangulation) of magnet position and/or orientation; discrimination between a single magnet (e.g., of a single control device) and multiple magnets and/or other magnetic field sources (e.g., stray fields from electrical devices, geomagnetic fields, etc.); signal noise reduction; or any other suitable signal processing or analysis. However, the sensor (s) 120 can have any other suitable location.

2.3 Processor.

The processor 130 functions to control the stimulation units 110, and can additionally control the sensor 120, power module 140, communication module 160, and/or any other suitable excitation device components. Additionally, the processor 130 can optionally function as a heating element (e.g., can additionally be a stimulation unit 110).

The processor 130 is preferably a microprocessor, but can additionally or alternatively be an electronic controller (e.g., control circuit), electromechanical controller (e.g., relay system), and/or any other suitable control module. The excitation device 100 can include one or more processors 130. The processor 130 can be in the center of the housing 150, on an interior or exterior surface of the housing 150, adjacent the power module 140, or in any other suitable location of the excitation device 100. Alternatively, the processor 130 can be the processing system of a user device (e.g., a smartphone), a remote computing system (e.g., a server system), or be any other suitable system (and/or the processor 130 can be configured to operate in cooperation with such a processing system).

The processor 130 is preferably configured to control the controlled subsets (e.g., stimulation units 110, groups of stimulation units 110, etc.) individually. For example, the processor 130 can be configured to selectively provide power from the power module 140 to each controlled subset (e.g., by regulating the current provided to each stimulation unit no, etc.), or to selectively command each controlled subset to enter an operation mode and/or attain a setpoint parameter value (e.g., by communicating a command to an integrated controller of each stimulation unit 110). The processor 130 (and/or excitation device) is preferably operable between multiple modes (e.g., configured to operate the stimulation units 110 and/or other excitation device components in multiple modes).

The processor 130 is preferably operable in one or more remote control modes, in which it is configured to control the stimulation units 110 based on signals sampled by the sensor 120 and/or received by the communication module 160. In a remote control mode, the stimulation units 110 are preferably controlled based on a control device parameter (e.g., distance, orientation, signal strength, etc.) and/or parameter change (e.g., rate of change, pattern, etc.), but can additionally or alternatively be controlled based on another control parameter, on commands and/or other information received by the communication module 160, and/or on any other suitable control information. The mapping between the control device parameter (and/or other control information) and the control of the stimulation units 110 can be predetermined, determined by a user (e.g., at a client executing on a user device, received by on-device controls such as switches, etc.), determined by machine learning and/or other data analysis techniques (e.g., based on other users' settings, based on usage of other sex toys by the user or other users, etc.), crowdsourced, or determined in any other suitable way.

Figure 12:
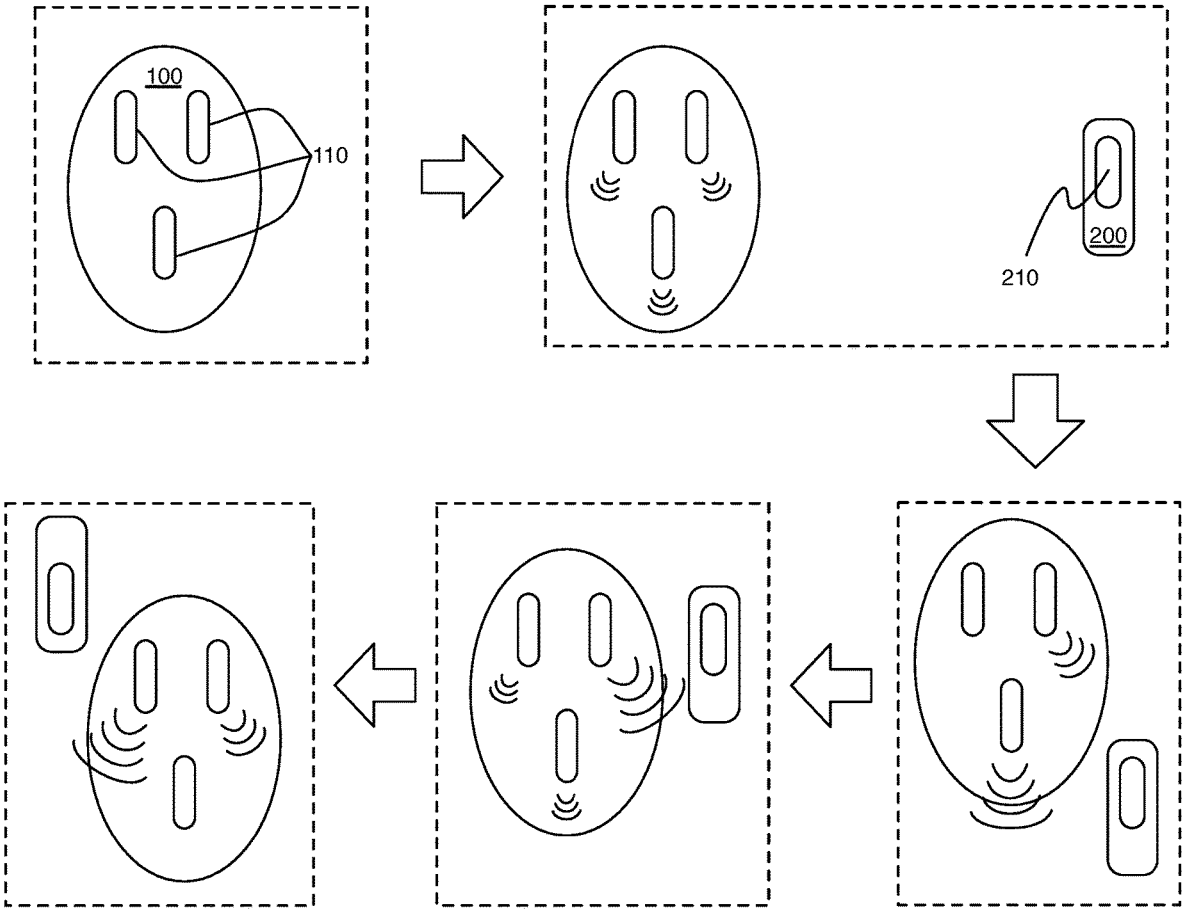
FIG. 12 is a schematic representation of an example of a method for using the system.
Figure 13A:
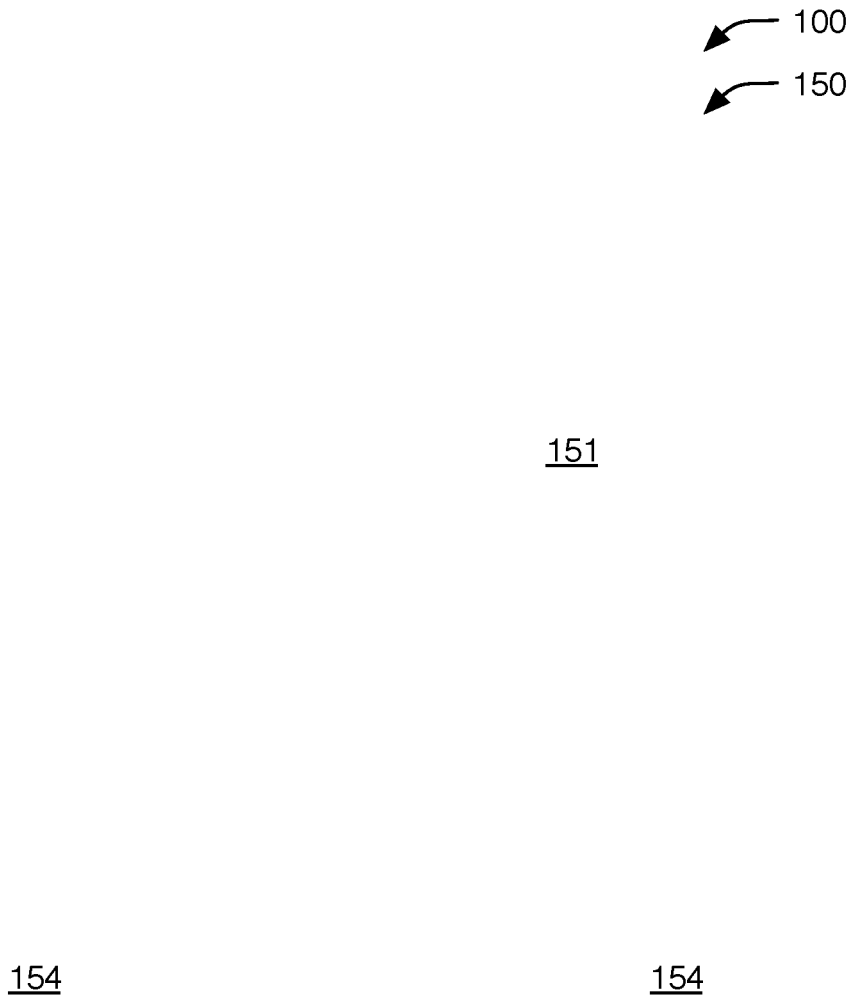
FIGS. 13A-13G are a top view, front view, back view, bottom view, side view, first isometric view, and second isometric view, respectively, of a seventh example of an excitation device.
Figure 13B:
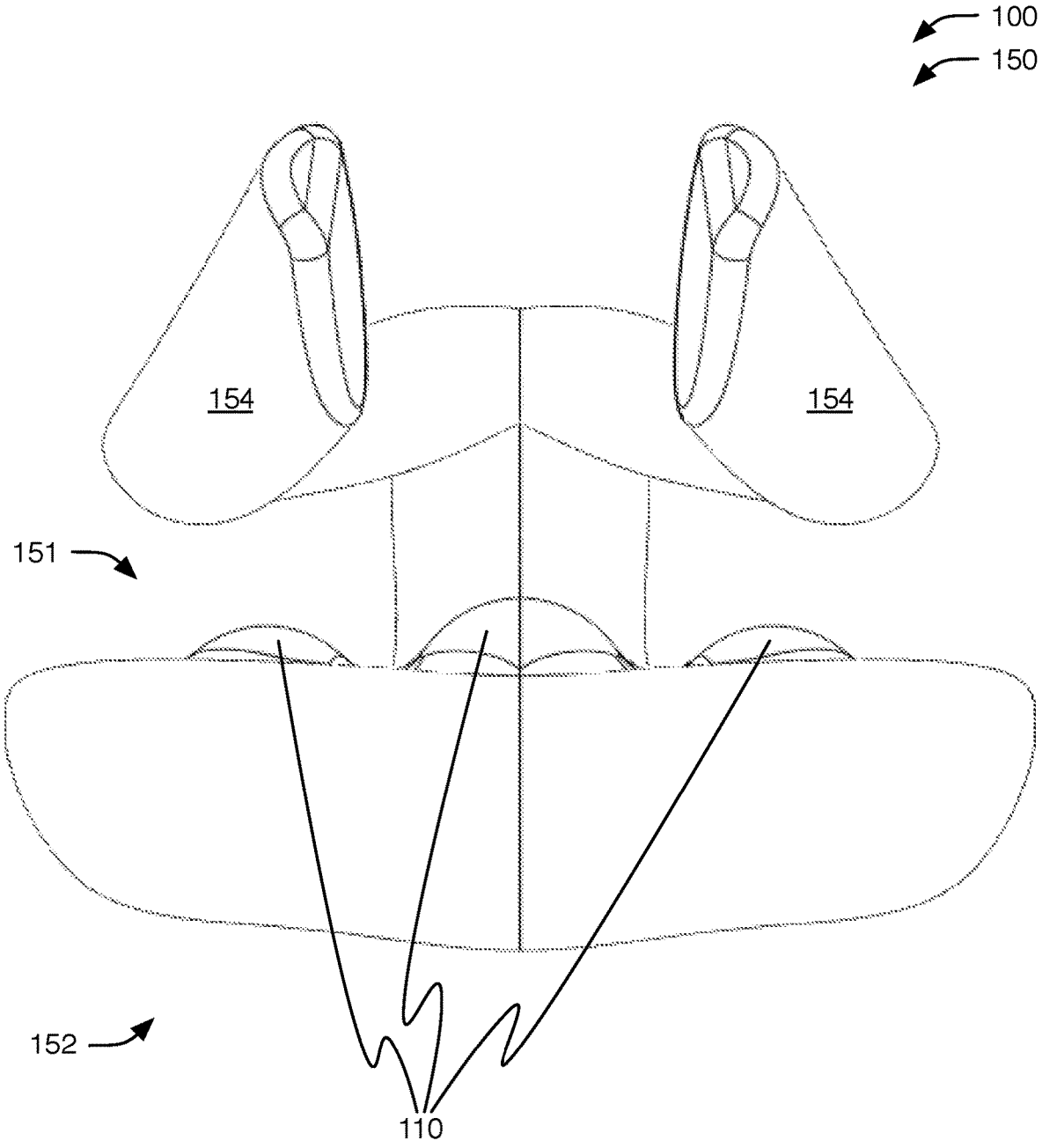
Figure 13C:
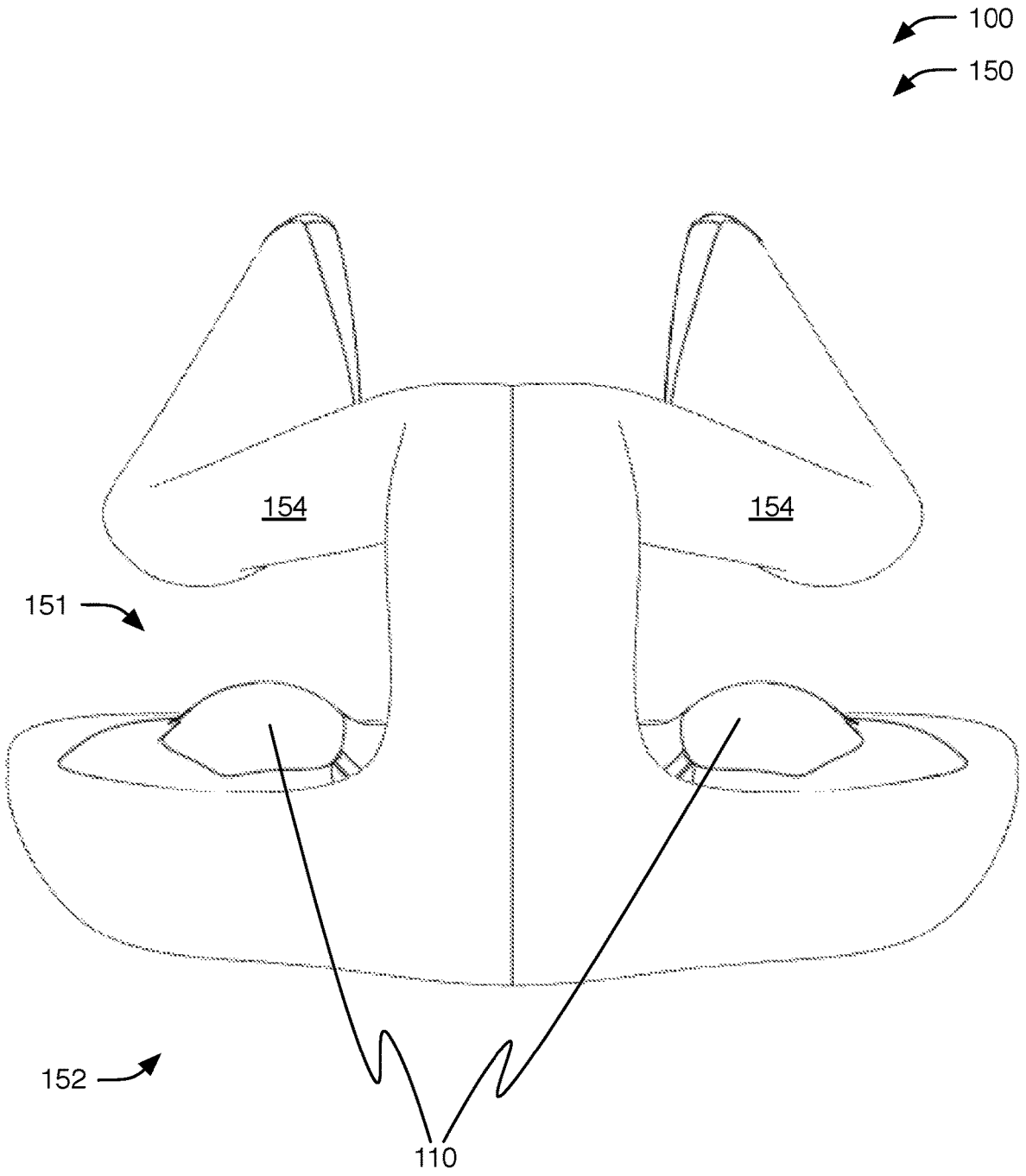
Figure 13D:
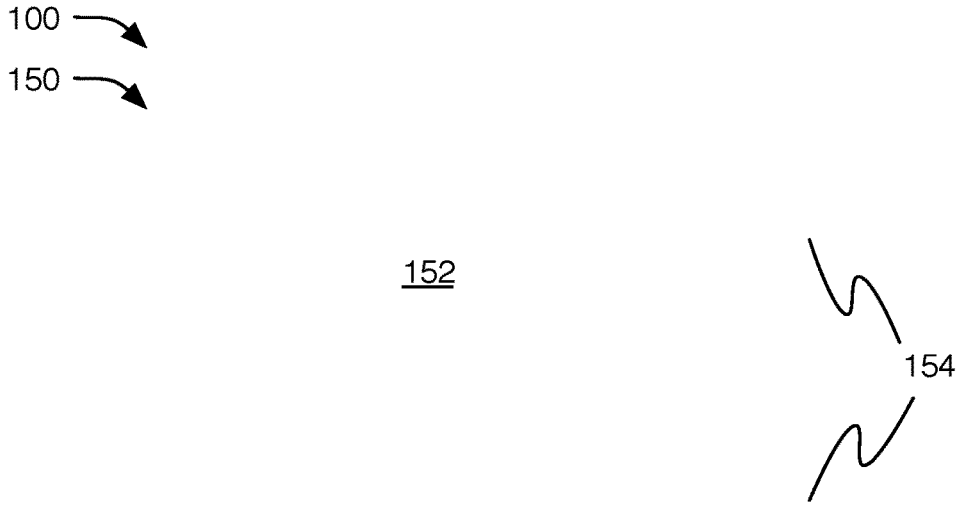
Figure 13E:
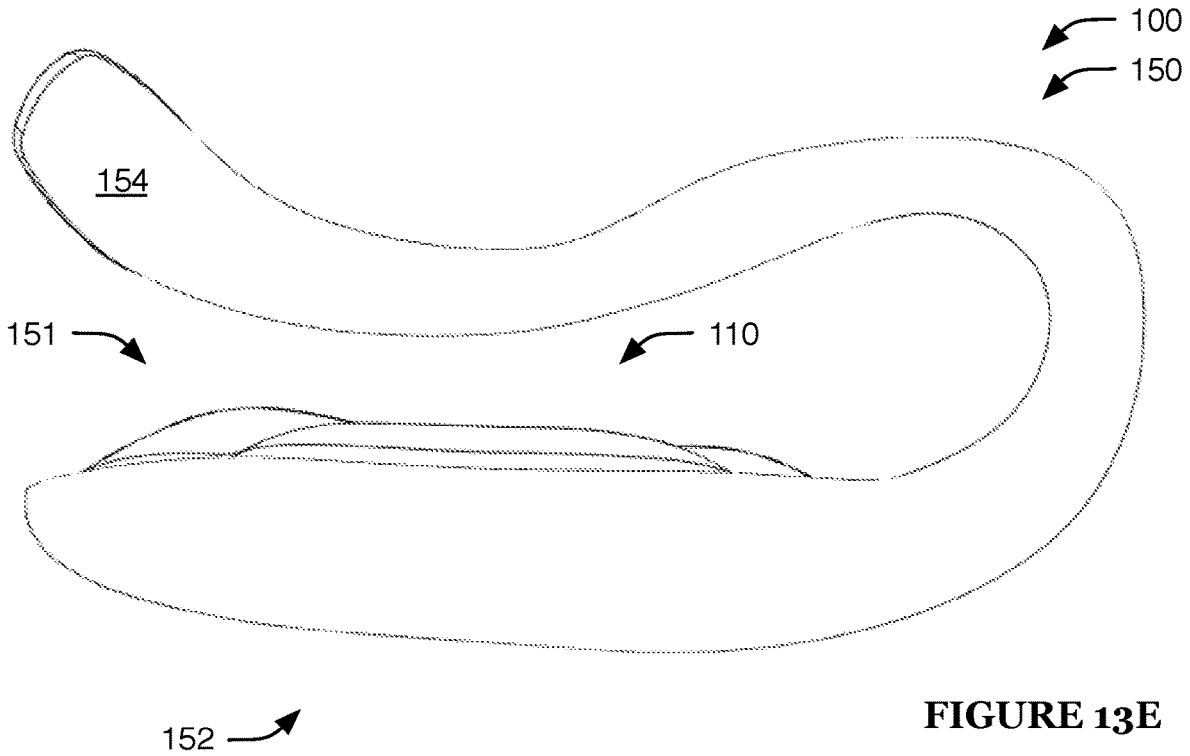
Figure 13F:
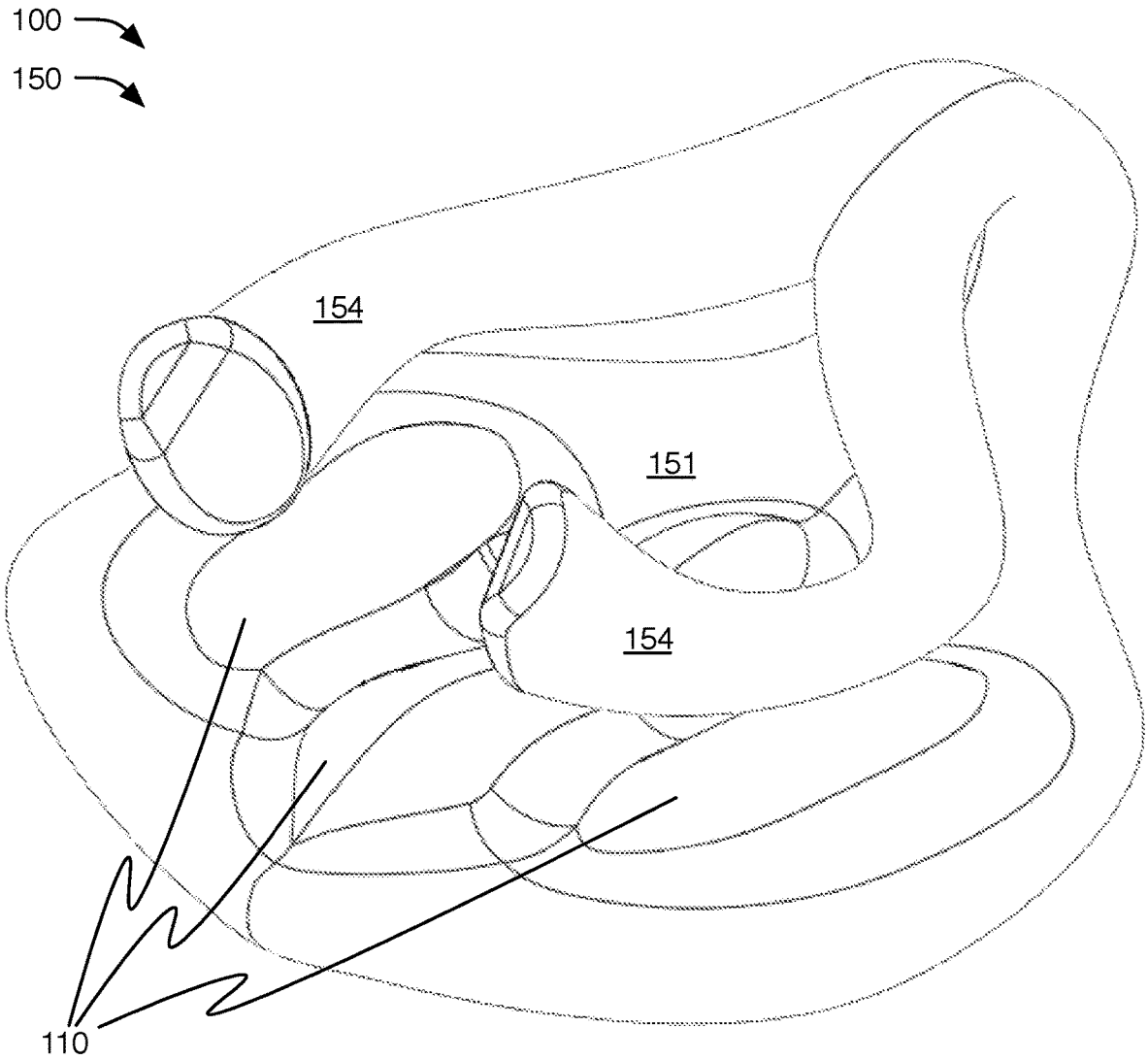
Figure 13G:
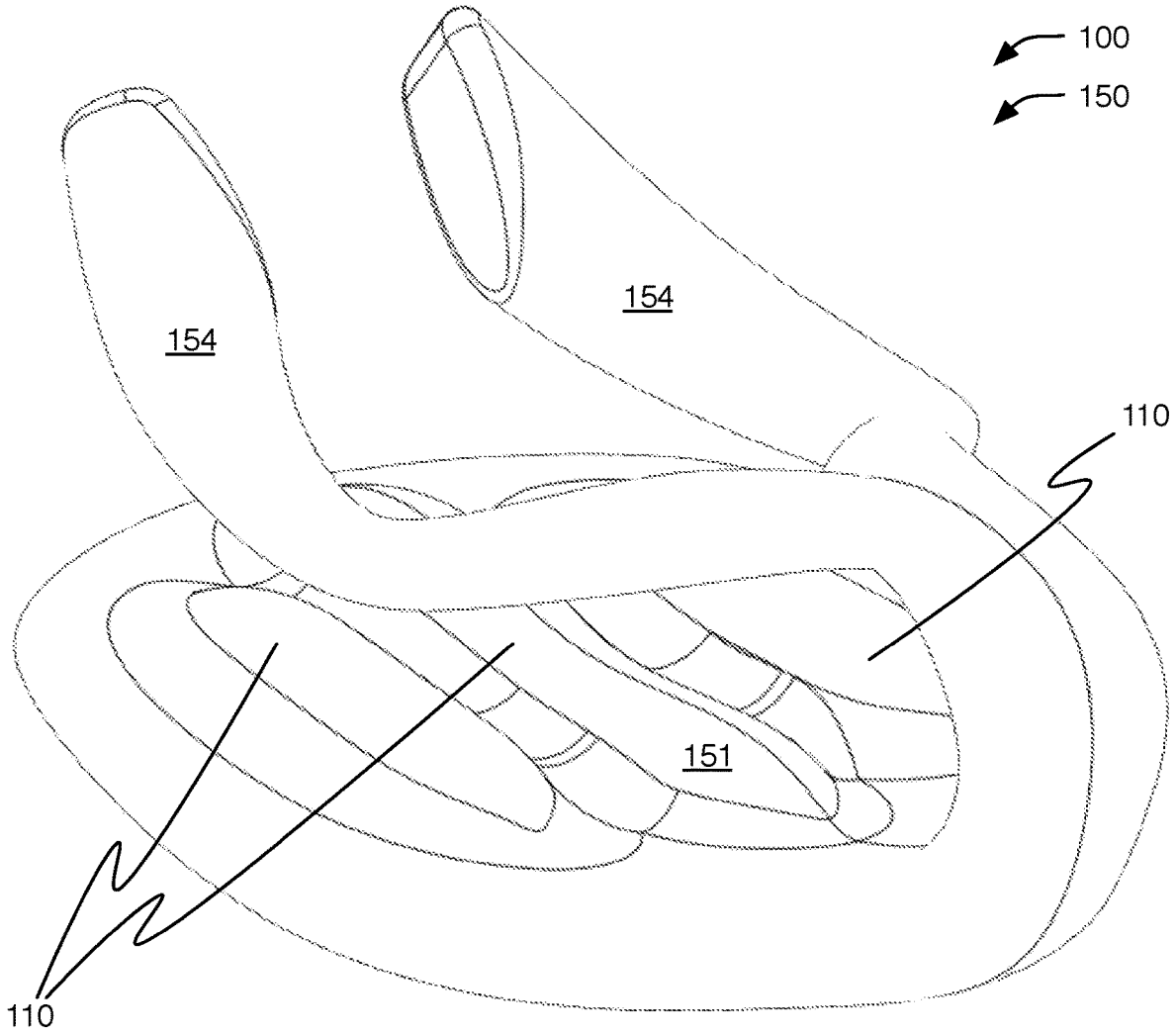

In a first variation of a remote control mode, the stimulation units 110 are controlled based on samples from the sensor 120 indicative of control device parameters. In this variation, the magnitude of stimulation unit actuation is preferably based on a control device parameter. In a first embodiment of this variation, the parameter is control device proximity, wherein a smaller distance (e.g., to the control device 200), or signal parameter values indicative of smaller distances (e.g., higher magnetic field strength, higher RSSI, higher LQI), is preferably mapped to stronger actuation (e.g., as shown in FIG. 12). Alternatively, smaller distances can be mapped to weaker actuation, or can be a non-monotonic function of distance. The control device distance is preferably a distance to each stimulation unit 110, controlled subset, or sensor 120 associated with a controlled subset. This can allow the user to perceive the control device 200 movement near their body (e.g., increasing intensity in a first region as the control device 200 approaches the first region, then intensity shifting to a second region as the control device 200 passes over the excitation device 100 toward the second region). Different controlled subsets and/or types of stimulation units 110 can have the same or different mappings between control device distance and actuation magnitude (e.g., at greater distances, only actuating a first set of vibratory actuators, and at closer distances, actuating the first set at a greater intensity, while also actuating a second set of vibratory actuators and heating elements). Additionally or alternatively, the control device distance can be a distance to any other component of the control device 200, to another landmark (e.g., body part of the user, another person, user device, remote target, previous control device location, etc.), and/or to any other suitable position. In a second embodiment, the parameter is control device speed (e.g., wherein faster control device movement is mapped to higher stimulation unit actuation intensities). In a third embodiment, the parameter is control device orientation.

In this variation, the controlled subsets can be selected based on the control device 200 position and/or orientation. For example, a controlled subset can be selected for actuation (or more intense actuation) when the control device 200 is close to and/or oriented toward the controlled subset, while other controlled subsets are selected for less intense actuation or no actuation. In a specific example, the control device 200 has a first side or end and a second side or end (e.g., opposing the first). In this specific example, when the first side or end is oriented toward the excitation device 100, the stimulation units 110 are operated in a "focused" mode, wherein actuation intensity is highly non-uniform spatially (e.g., a first controlled subset or set of nearby controlled subsets, selected based on control device orientation and/or position, are operated at high intensity, while the other controlled subsets are operated at low or zero intensity). Further, in this specific example, when the second side or end is oriented toward the excitation device 100, the stimulation units 110 are operated in a "diffuse" mode, wherein actuation intensity is less non-uniform spatially (e.g., substantially uniform, more gradual intensity reduction, non-uniformity less than a threshold amount of the maximum intensity, etc.).

In a second specific example, the processor 130 determines the control device position and signal intensity based on the measurements sampled by the sensor 120, identifies the controlled subset proximal the control device 200 (primary controlled subset), determines a primary output magnitude based on the signal intensity, and selectively operates the primary controlled subset to output at the primary output magnitude. This specific example can optionally include determining one or more secondary output magnitudes for controlled subsets adjacent and/or proximal the primary controlled subset (secondary controlled subsets) and selectively operating the secondary controlled subsets to output the secondary output magnitude(s). The secondary output magnitudes are preferably less than the primary output magnitude, and can be determined based on the primary output magnitude (e.g., scaled according to a predetermined rule, such as based on distance between the primary and secondary controlled subset) or be otherwise determined.

This variation can additionally or alternatively include detecting a movement pattern (or any motion) of the control device 200. In a first embodiment, the processor 130 controls the stimulation units 110 to simulate the detected movement pattern. For example, in-plane control device movement patterns (e.g., plane parallel to a primary plane of the control device 200 or excitation device 100, plane normal to a gravity vector, etc.) can be mapped to controlled subset selection patterns (e.g., changing the primary controlled subset over time to follow control device motions such as circling motions, back-and-forth motions, up-and-down motions, flicking motions, etc.), while out-of-plane movement patterns can be mapped to output intensities (e.g., changing the primary output magnitude based on the out-of-plane motion), mapped to linear actuator control (e.g., simulating thrusting or insertion motions), and/or mapped to any other suitable control. In a second embodiment, control device movement patterns are mapped to predefined patterns or settings (e.g., spatial patterns, temporal intensity patterns, etc.). However, the control device motions can additionally or alternatively be used in any other suitable way.

In a second variation of a remote control mode, the processor 130 controls the stimulation units 110 based on proximity to a potential partner (e.g., romantic and/or sexual partner) or user device of the potential partner. The stimulation units 110 are preferably actuated in response to determination of a nearby potential partner, more preferably increasing in intensity for smaller distances. Information about potential romantic partners is preferably received from a client application executing on a user device. Potential romantic partners can be determined based on user-selected matches (e.g., mutual selection, unilateral selection, etc.), based on predicted compatibility determined by user profiles, and/or based on any other suitable criteria.

In a third variation of a remote control mode, the processor 130 controls the stimulation units 110 to provide navigational information. For example, the stimulation units 110 can be controlled to indicate a compass direction (e.g., highest output magnitude at the most northern controlled subset, as determined by a magnetometer) or to provide turn-by-turn instructions (e.g., highest output magnitude at the controlled subset oriented toward an upcoming turn, based on navigation instructions received from a user device). However, the processor 130 can operate the stimulation units 110 based on any other suitable remote control mode.

The processor 130 is preferably also operable in a standby or off mode, wherein the stimulation units 110 are not actuated (and preferably consume little or no power). The standby or off mode can additionally or alternatively include powering down or reducing the power consumption of the sensor 120, processor 130, and/or any other suitable excitation device components. The standby or off mode can be entered based on detection of a control device pattern corresponding to a predefined pattern (e.g., "off" or "standby" pattern), based on the control device signal intensity being less than a threshold intensity (e.g., for a threshold period of time), based on user actuation of an on-device control (e.g., power or standby button), based on a command received from a user device client (e.g., in response to user selection of an off or standby option at the client), and/or based on any other suitable criteria.

The processor 130 can additionally or alternatively be operable in one or more predefined output modes, which can function to control the stimulation units 110 without information from the sensor 120 and/or communication module 160. A predefined output mode can be entered based on detection of a control device pattern corresponding to a predefined pattern (e.g., tapping pattern including a predefined number of taps, such as 1, 2, 3, or 4 taps; shaking pattern; waving pattern; control device orientation change, such as reversing a direction of a magnetic element of the control device; stationary pattern, such as lack of substantial control device motion over a threshold period of time; etc.), based on user actuation of an on-device control, based on a command received from a user device client (e.g., in response to user selection of an output setting at the client), and/or based on any other suitable criteria. In a predefined output mode, the processor 130 can control the stimulation units 110 to actuate at a constant magnitude (e.g., all controlled subsets actuated at the same magnitude), based on a predefined pattern (e.g., wherein the most intense output moves based on the pattern, such as along a circular or zig-zag path), randomly, or with any other suitable magnitudes and timing. In one example, the excitation device 100 can repetitively pulse one vibratory actuator and then another vibratory actuator. In another example, the excitation device 100 can repetitively ramp the vibratory motors up and down and out of phase, such as 45°, 90°, or 180° out of phase. In yet another example, the excitation device 100 can continuously drive one vibratory motor and pulse another vibratory motor at pseudorandomly-selected times and power settings, such as every one to five seconds for between one half and two seconds between 50% and 100% power. However, the processor 130 can additionally or alternatively be operable in any other suitable mode(s).

The processor 130 (and/or sensor 120, signal filtering module of the excitation device 100, remote device, etc.) can be configured to perform noise filtering on the sampled signals. In a first example, the processor 130 only actuates the stimulation units 110 in response to signals above a threshold intensity. In a second example, algorithmic filtering (e.g., Kalman filtering) is performed on the sampled signals and/or the sampled signals are analyzed using a machine learning technique (e.g., kernel analysis method, such as one using a Gaussian kernel). In a third example, the signals are filtered by a low-pass filter circuit (e.g., RC circuit). However, any suitable filtering can be performed.

The excitation device 100 can be paired with a specific control device 200 or set of control devices 200 (e.g., wherein the excitation device 100 is not responsive to signals from other control devices 200 with which it is not paired). For example, the devices can be paired automatically (e.g., based on proximity, based on established wireless communication, etc.), pre-paired (e.g., at a manufacturing or packaging facility), paired manually (e.g., based on code entry, pairing button actuation, commands from a user device client, etc.), or otherwise paired. Alternatively, the excitation device 100 can be responsive to signals from any control device 200.

The processor 130 can additionally or alternatively capture, store, and/or transmit data associated with the excitation device 100 (e.g., usage times and durations, stimulation patterns, user feedback and/or biometrics, etc.). This data can be used (e.g., as a training set for a statistical model) to determine new or preferred stimulation patterns and usage habits.

The system can additionally or alternatively include any other suitable elements (e.g., of the excitation device 100, of the control device 200, of a remote device, etc.) that implement all or some of the operation modes (e.g., together with the processor 130, independently from the processor 130, in place of the processor 130, etc.) and/or other processing functions, and/or control the excitation device 100 (and/or any other suitable elements of the system) in any other suitable manner.

2.4 Power Module.

The power module 140 preferably functions to supply power to the stimulation units 110, and can additionally supply power to the sensor 120, processor 130, communication module 160, and/or any other suitable excitation device components. Additionally, the power module 140 can optionally function as a heating element (e.g., can additionally be a stimulation unit 110). The power module 140 can be located inside the housing 150, on an interior surface 151 (e.g., user-contacting surface), exterior surface 152 (e.g., opposing an interior surface), or in any other location.

The power module 140 preferably includes a power storage element. The power storage element preferably includes a battery, more preferably a secondary battery but alternatively a primary battery, but can additionally or alternatively include a capacitor (e.g., to facilitate fast discharging in combination with a battery), a fuel cell with a fuel source (e.g., metal hydride), and/or any other suitable power storage element. The secondary battery can have a lithium phosphate chemistry, lithium ion polymer chemistry, lithium ion chemistry, nickel metal hydride chemistry, lead acid chemistry, nickel cadmium chemistry, metal hydride chemistry, nickel manganese cobalt chemistry, magnesium chemistry, or any other suitable chemistry. The primary battery can have a lithium thionyl chloride chemistry, zinc-carbon chemistry, zinc chloride chemistry, alkaline chemistry, oxy nickel hydroxide chemistry, lithium-iron disulfide chemistry, lithium-manganese oxide chemistry, zinc-air chemistry, silver oxide chemistry, or any other suitable chemistry. The battery is preferably electrically connected to the powered excitation device components, wherein the processor 130 preferably controls power provision (e.g., through component operation mode control), but power provision and/or battery management can alternatively be performed by any other suitable component.

The power module 140 can additionally or alternatively include a power input element (e.g., to charge the battery, to directly power the excitation device components, etc.). The power input element preferably includes a conductive electrical connector (e.g., USB connector, coaxial connector, etc.) and/or inductive coupling element (e.g., configured to receive power inductively from an inductive charging device), but can additionally or alternatively include a thermal energy converter (e.g., thermionic converter, thermoelectric converter, mechanical heat engine, etc.) optionally with a heat source (e.g., radioactive material), a mechanical energy converter (e.g., vibrational energy harvester), a solar energy converter, and/or any other suitable power input element.

2.5 Housing.

The housing 150 functions to retain the other excitation device components. The excitation device components can be contained within the housing 150 (e.g., enclosed by the housing 150, press-fit into the housing 150, etc.), retained at a surface of the housing 150 (e.g., adhered to the surface, mechanically fastened to the surface, etc.), and/or otherwise retained by the housing 150. The housing 150 can have the same shape and/or material(s) as the control device housing 220, or can have a different shape and/or material(s).

Figure 14A:
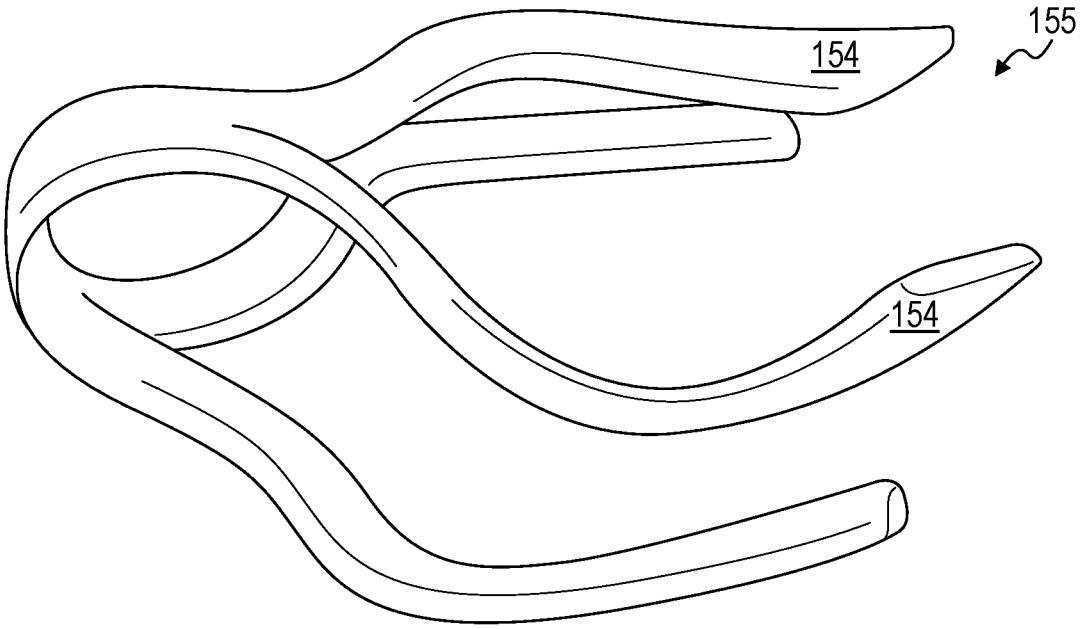
FIGS. 14A-14B are perspective views of a skeleton and sheath, respectively, of the seventh example of the excitation device.
Figure 14B:
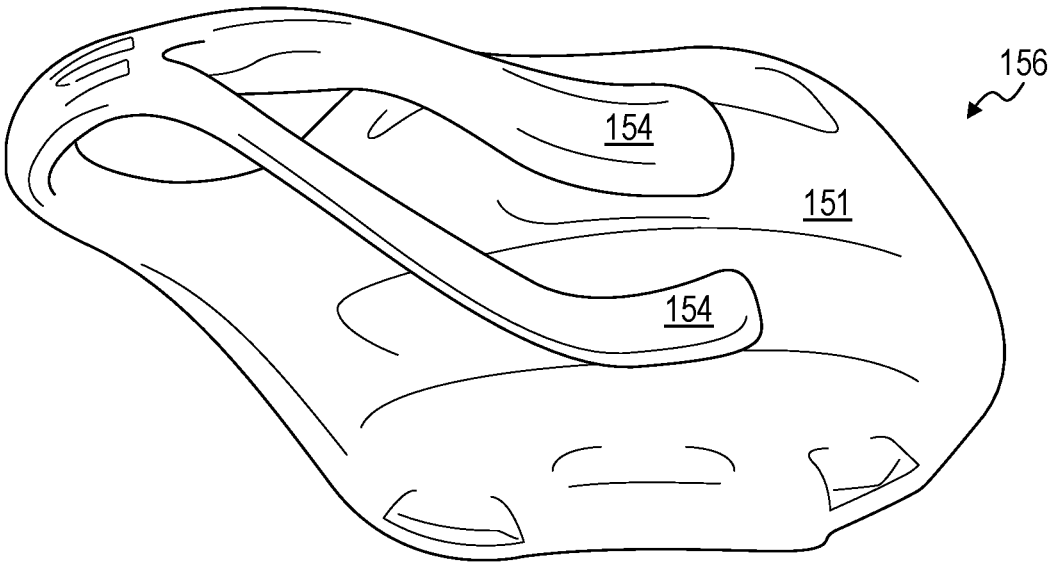
Figure 15:
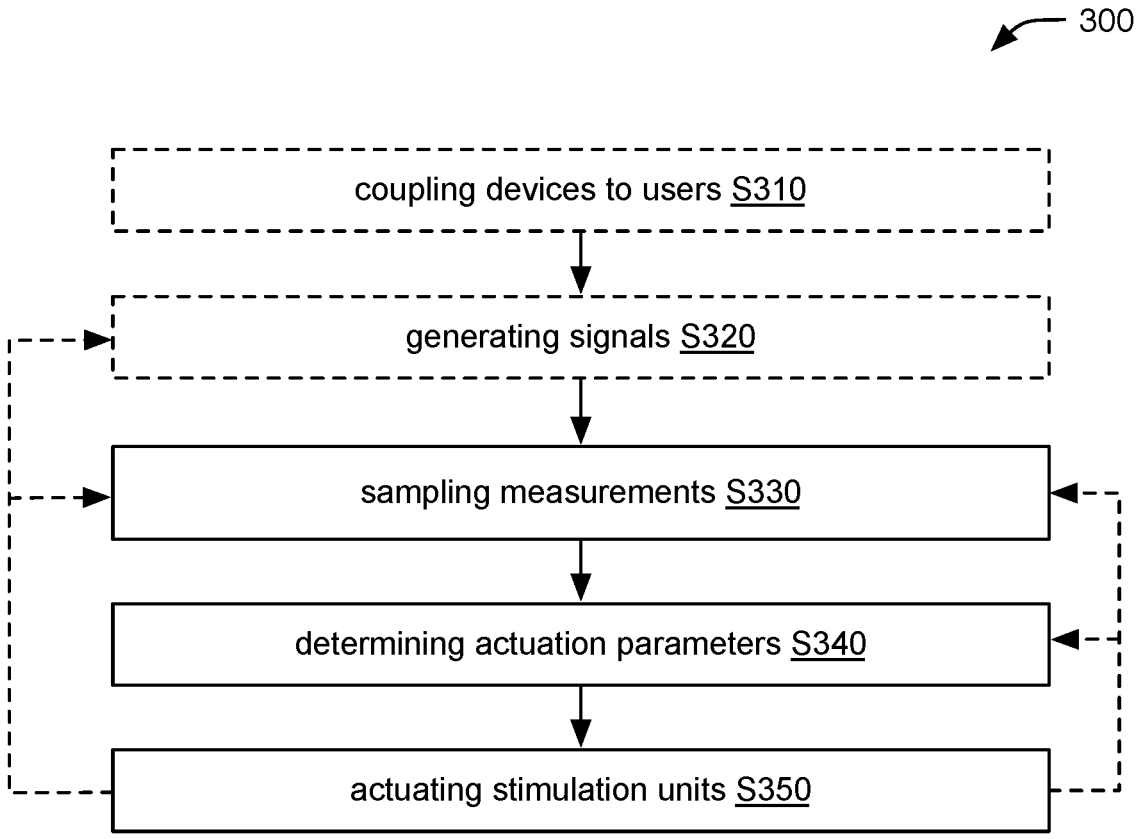
FIG. 15 is a schematic diagram of an embodiment of the method.

The housing 150 preferably includes (e.g., is made of) one or more flexible materials such as an elastomer (e.g., silicone rubber) or other flexible polymer, and can additionally or alternatively include one or more rigid and/or semi-rigid materials (e.g., metal, rigid polymer, etc.), preferably partially or fully enclosed by flexible material. For example (e.g., as shown in FIGS. 14A-14B), the housing 150 can include a skeleton 155 (e.g., including rigid and/or semi-rigid material) and a sheath 156 (e.g., including flexible material). The skeleton 155 preferably functions to mechanically support the sheath 156. The sheath 156 preferably encases (e.g., partially, entirely, etc.) the skeleton 155, but the skeleton 155 can additionally or alternatively be arranged outside the sheath 156 (e.g., can function as an exoskeleton) and/or have any other suitable arrangement.

The housing materials can be transparent, translucent, or opaque. The housing 150 preferably defines one or more interior surfaces 151 configured to contact the user when the excitation device 100 is worn, and one or more exterior surfaces 152 (e.g., opposing an interior surface 151, configured not to contact the user when the excitation device 100 is worn, etc.). The interior surface 151 is preferably made of the flexible material and configured for comfortable contact with the user (e.g., contoured according to the target body part to be contacted, soft, smooth, etc.).

The housing 150 can optionally function to couple the excitation device 100 to the user (e.g., at a target body part). In a first variation, the housing 150 is configured to be held in place by an article of clothing. For example, the excitation device 100 can be pressed against a user's breast by a bra cup, pressed against the user's genitals by an underwear crotch, or held close to the user's body within a clothing pocket or clipped to the clothing (e.g., to a waistband or bra). Alternatively, the excitation device 100 can be integrated into the clothing.

In a second variation, a surface attachment mechanism (e.g., adhesive material, suction cup, skin clamp, etc.) on an interior surface 151 can attach the excitation device 100 to the user.

Figure 6:
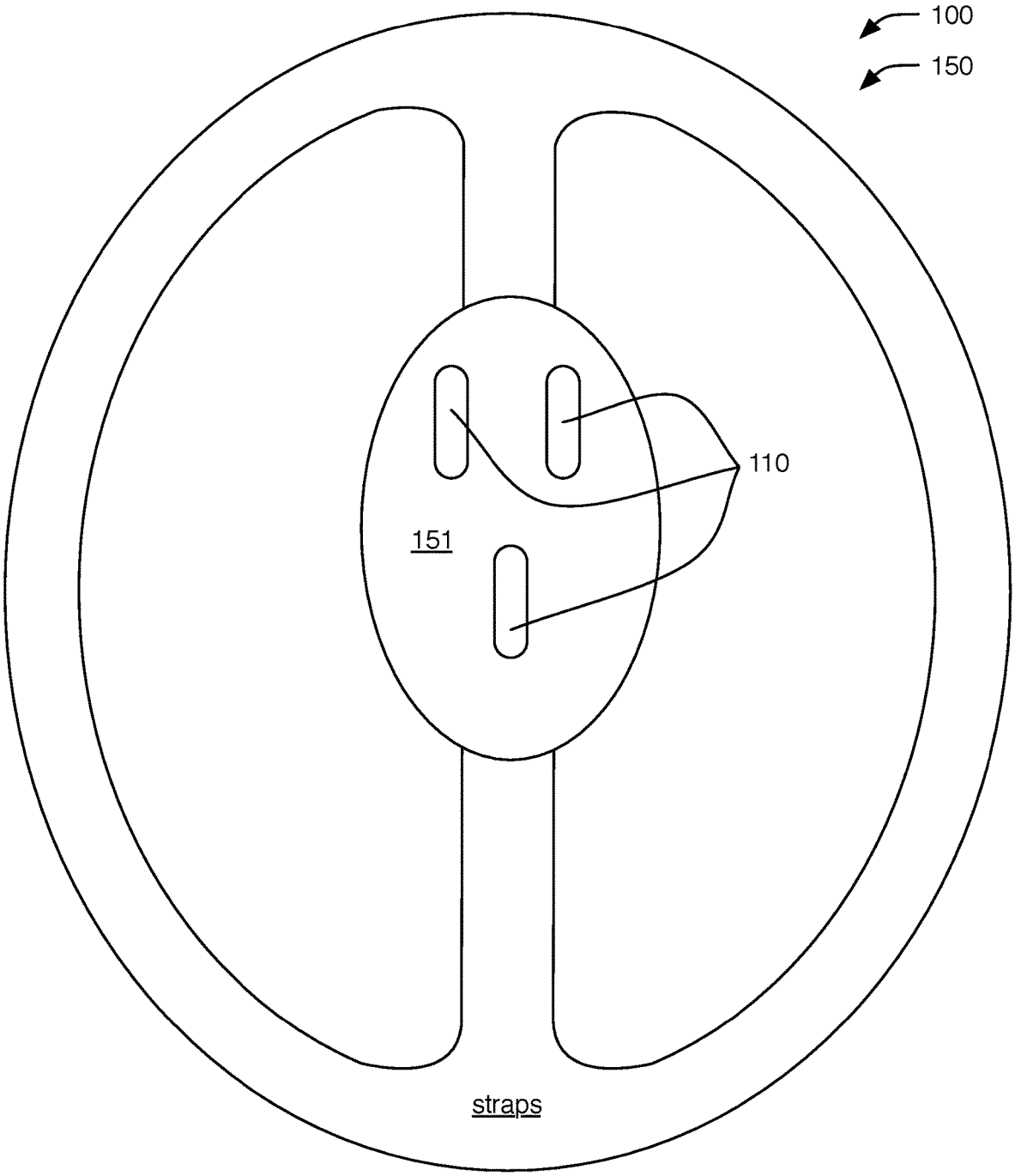
FIG. 6 is an overhead view of a fifth example of the excitation device.

In a third variation, the housing 150 includes fasteners to fasten the excitation device 100 to the user (e.g., as shown in FIG. 6). In a first example of this variation, the housing 150 includes straps, chains, and/or strings configured to encircle one or more body parts (e.g., harness straps, necklace chain, etc.). In a second example, the housing 150 includes hooks, clips, and/or other fasteners configured to connect to jewelry worn in a body piercing, and/or includes jewelry (e.g., ring, barbell, etc.) to be worn in a body piercing.

Figure 7:
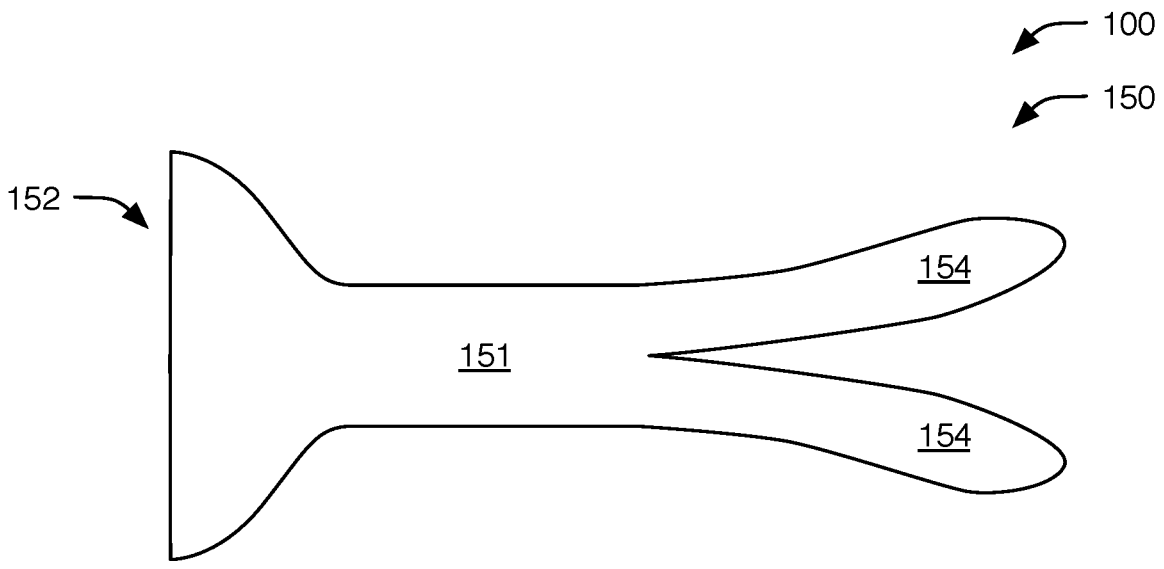
FIG. 7 is an overhead view of a sixth example of the excitation device.

In a fourth variation, the housing 150 is configured to be inserted into and retained by a body cavity (e.g., vagina, rectum, etc.). In one example of this variation, the housing 150 can include an extended region, bifurcated into two (or more) retention members 154 (e.g., at one end; joined at multiple locations, such as on either end; etc.), wherein each retention member 154 of the bifurcated section is configured to apply a retaining force, such as an outward force (e.g., radially outward, away from the other bifurcated section, etc.), when the extended region is inserted into the body cavity (e.g., as shown in FIG. 7). The retention members 154 can preferably be moved relative to each other (e.g., can be squeezed closer to one another to facilitate insertion), more preferably exerting a restoring force (e.g., by one or more spring elements, such as a semi-rigid portion of the member or members) in response to such deformation (e.g., the retaining force), but can additionally or alternatively be substantially rigidly coupled (e.g., wherein the retention members are retained by an inward force exerted by the body cavity). For example (e.g., as shown in FIGS. 14A-14B), the retention members 154 can be cooperatively defined by a skeleton 155 (e.g., semi-rigid skeleton, such as a metal and/or plastic skeleton) arranged within a sheath 156 (e.g., flexible sheath, such as a silicone sheath), wherein the skeleton 155 provides the restoring force to retain the extended region within the body cavity. In this variation, the housing 150 can additionally or alternatively include a broad region opposing the extended region, which can function to prevent complete envelopment of the housing 150 by the body cavity, and/or a portion (preferably containing one or more stimulation units 110) configured to contact a clitoris, anus, perineum, and/or other body part when the housing 150 is inserted into the body cavity. In a specific example of this variation (e.g., as shown in FIGS. 13A-13G), the excitation device 100 includes two semi-rigid retention members 154 and a main housing portion opposing the retention members. The main housing portion preferably houses some or all of the excitation device elements, such as the stimulation units 110 (e.g., vibratory actuators), sensor 120, processor 130, power module 140, communication module 160, and/or any other suitable elements. The retention members are configured to be inserted into a user's vagina, retaining the main housing portion near (e.g., against) the user's vulva (e.g., pressing the main housing portion against the user's vulva and/or pubis, thereby facilitating transmission of mechanical vibration from the vibratory actuators to the user), preferably on and/or near the user's clitoris but additionally or alternatively in any other suitable arrangement.

In a fifth variation, the housing 150 (e.g., flexible material of the housing) is configured to encircle and retain the housing 150 against a body part (e.g., penis, finger, wrist, neck, etc.). For example, the housing can define an aperture into which the body part can be inserted. When inserted, the body part preferably stretches the housing (e.g., the aperture), such that the housing exerts a restoring force (e.g., inward force) that retains the housing against the body part.

Additionally or alternatively, all or some of the excitation device 100 can be embedded in the user. For example, the excitation device can be surgically implanted within the user, tattooed onto the user (e.g., including magnetic ink embedded in the user's skin, configured to move and/or exert force on the user in response to presence of a magnetic field), and/or embedded in the user in any other suitable manner. However, the housing 150 can otherwise be operable to couple the excitation device 100 to the user, or can optionally not function to couple the excitation device 100 to the user.

The housing 150 can optionally include one or more input regions 153, which can function to receive control inputs from a user. An input region 153 can be a button, flexswitch, touch sensor (e.g., capacitive, resistive), and/or any other suitable input. Additionally or alternatively, the input regions 153 can include a dial, a slide, a series of toggle switches, or other type of input region, button, or control. For example, the input regions 153 can include a dial, through which the user can adjust the stimulation intensity, and a momentary mechanical pushbutton, through which the user can power the excitation device 100 ON and OFF and cycle through available modes (e.g., vibratory pattern settings). Additionally or alternatively, the excitation device 100 can include a spatial sensor (e.g., accelerometer) that functions to receive control inputs from the user. For example, the accelerometer can cycle through device settings (e.g., power settings, output intensity settings, etc.) in response to detecting a signal indicative of a tap (e.g., fingertap) on the housing 150, and/or can map detected excitation device movements to device settings. However, the input regions 153 can be of any other type, capture any other user input, and modify operation of the excitation device 100 in any other way.

The housing 150 can optionally include shielding, which can function to shield the sensor 120 from some signals (e.g., spurious signals originating from unintended sources and/or directions). For example, the housing 150 can include a mu-metal (e.g., nickel-iron alloy such as ASTM A753 Alloy 4) layer arranged between a Hall effect sensor of the excitation device 100 and a magnet of the excitation device 100, which can function to reduce the magnetic field produced by the magnet at the Hall effect sensor. However, the housing 150 can include any other suitable shielding. Additionally or alternatively, the sensor 120 and/or processor 130 can be configured to account for the undesired signals (e.g., based on a predetermined calibration).

2.6 Communication Module.

The excitation device 100 can optionally include a communication module 160, which functions to receive wireless communications (e.g., via WiFi, Bluetooth, cellular radio, etc.) from other devices and/or computing systems. The communication module 160 can be contained within the housing 150 and is preferably electrically coupled to the power module 140 and the processor 130 and operable to transmit data to and/or be controlled by the processor 130. The communication module 160 can include one or more radios for the same or different protocol (e.g, capable of communicating and/or configured to communicate using the same or different communication protocol).

In a first variation, the sensor 120 is a remote sensor (e.g., not connected to the housing 150, not electrically coupled to the stimulation units 110, etc.). The remote sensor can be connected to or separate from the control device 200. In this variation, information based on measurements sampled by the remote sensor (e.g., the measurements, analysis based on the measurements, control instructions based on the measurements and/or analysis, etc.) are wirelessly transmitted to the communication module 160 (e.g., from the remote sensor, from a processor and/or radio connected to the remote sensor, etc.). In response to receiving the information, the communication module 160 transmits the information to the processor 130.

In a second variation, the communication module 160 can receive control instructions from a remote device (e.g., control device 200, user device, remote computing system, etc.). The control instructions can be instructions to operate in a mode or with a specific predefined output pattern, instructions to change an output intensity, instructions to define a new output pattern, and/or any other suitable instructions.

The communication module 160 can additionally or alternatively transmit control instructions and/or other information (e.g., sensor measurements, control device positions, etc.) to a remote device (e.g., control device 200, user device, remote computing system, etc.). For example, the communication module 160 can transmit control instructions to a control device communication module, enabling actuation of control device stimulation units in a complementary manner (e.g., substantially similar manner, synchronized actuation, actuation at proportional intensities, etc.) to the actuation of the excitation device stimulation units 110. However, the communication module 160 can additionally or alternatively receive and/or send any other suitable wireless communications, and the excitation device 100 can include any other suitable component(s).

3. Control Device.

The control device 200 is preferably separate from the excitation device 100, more preferably configured to be used near (e.g., within 1 foot, within 1 m, having a direct line of sight, etc.) the excitation device 100 but can additionally or alternatively be configured to be used remotely. The control device 200 can optionally be configured to mate with the excitation device 100 (e.g., wherein the control device 200 and excitation device 100 include complementary mating structures).

Alternatively, the control device 200 can be mechanically connected to the excitation device 100. In one example, the control device 200 can be flexibly connected to the excitation device 100 and configured to move with respect to the sensor 120 in response to user manipulations (e.g., pushing, pulling, twisting, thrusting, spinning, etc.). In a second example in which the excitation device 100 and control device 200 are connected, the control device 200 controls a second excitation device 100' to which it is not connected (e.g., and does not control the first excitation device 100, to which it is connected). In this example, the second excitation device 100' can be connected to a second control device 200' (e.g., which controls the first excitation device 100). The excitation and control devices can be of the same or different types (e.g., using the same or different signals, same or different stimulation units, same or different housing configurations, such as configured to couple to similar or different body parts, etc.). However, the excitation device 100 and control device 200 can have any suitable relation.

3.1 Outputs.

The one or more outputs 210 of the control device 200 function to generate the control device signal. In a first embodiment, the outputs 210 are magnetic outputs, preferably permanent magnets such as rare earth magnets (e.g., samarium-cobalt magnets, neodymium magnets), magnets including ferromagnetic elements (e.g., iron, cobalt, nickel), composite magnets (e.g., ferrite magnets, alnico magnets), but additionally or alternatively electromagnets, magnetic shielding such as mu-metal, and/or any other suitable magnets or elements that affect magnetic fields. In one example of this embodiment, at least one of the excitation device sensors 120 is a Hall effect sensor, and the stimulation units 110 are controlled based on the control device 200 position relative to the excitation device 100, as determined based on the magnetic field signals sampled by the Hall effect sensor (s).

In a second embodiment, the outputs 210 are audio outputs such as speakers and/or any other suitable sounds generators (e.g., wherein the stimulation units 110 are controlled based on sound pitch, intensity, and/or patterns sampled at the excitation device sensor(s) 120). In a third embodiment, the outputs 210 are electromagnetic wave outputs. In a first example of this embodiment, the outputs 210 are light emitters, such as lightbulbs, light-emitting diodes, and/or any other suitable light emitters (e.g., wherein the stimulation units 110 are controlled based on light intensity, wavelength, and/or patterns sampled at the excitation device sensor(s) 120). In a second example (e.g., wherein the control device 200 is a beacon or a user device such as a smartphone or smartwatch), an output 210 is a radio wave transmitter such as a Wi-Fi, Bluetooth, BLE, NFC, and/or other short-range communication radio (e.g., wherein the stimulation units 110 are controlled based on radio wave signal strength sampled at the excitation device sensor(s) 120). In a fourth embodiment, the outputs 210 are mechanical or haptic outputs. In a fifth embodiment, the outputs 210 are thermal outputs (e.g., generated by a heater and/or cooling element of the control device, such as a resistive heater and/or a Peltier cooler; body heat, such as in a variation in which the control device is, includes, or is coupled to a human body part; heat emitted by a control device otherwise heated to an elevated temperature and/or cooled to a depressed temperature; etc.). However, the outputs 210 can additionally or alternatively generate any other suitable signal.

The outputs 210 can optionally be controlled by a control device processor, powered by a control device power module, controlled based on signals received from a control device sensor and/or control device communication module, and/or can have any other suitable interactions with any other suitable control device components.

3.2 Housing.

The housing 220 of the control device 200 functions to retain the outputs 210 (and/or any other suitable control device components). The outputs 210 and/or other control device components can be contained within the housing 220 (e.g., enclosed by the housing 220, press-fit into the housing 220, etc.), retained at a surface of the housing 220 (e.g., adhered to the surface, mechanically fastened to the surface, etc.), and/or otherwise retained by the housing 220.

Figure 8A:
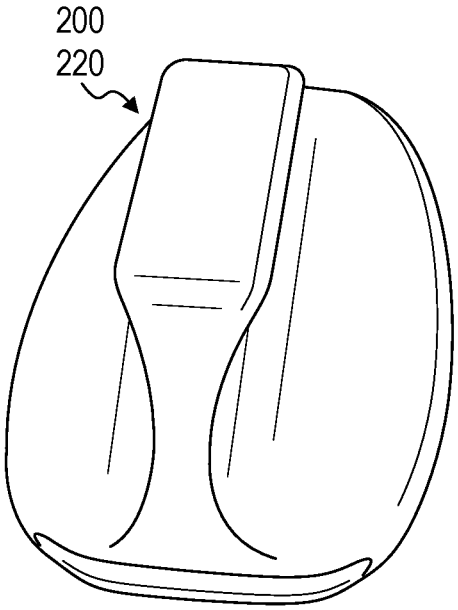
FIGS. 8A and 8B are perspective views of a first example of the control device.
Figure 8B:
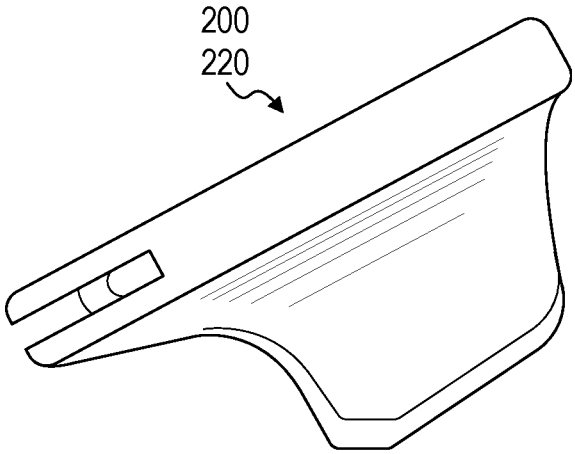
Figure 9:
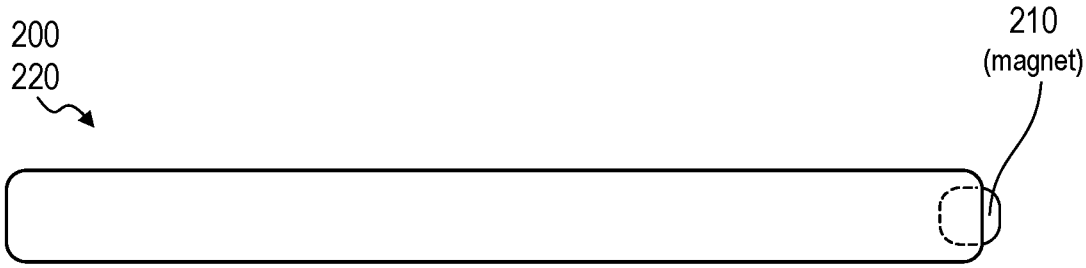
FIGS. 9 and 10 are overhead views of a second and third example of the control device, respectively.

The housing 220 can optionally function to couple the control device 200 to a user (e.g., the user to which the excitation device 100 is coupled, a sexual partner or potential sexual partner of the excitation device user, etc.). In a first variation, the housing 220 is configured to be held by the user (e.g., as shown in FIGS. 8A-B and FIG. 9). In specific examples of this variation, the housing 220 is configured to be held in a hand, between two fingertips, or between the sides of two adjacent fingers (e.g., defining two cylindrical concavities), and/or is a wand, whip, set of handcuffs, blindfold, or any other suitable shape to be held.

Figure 10:
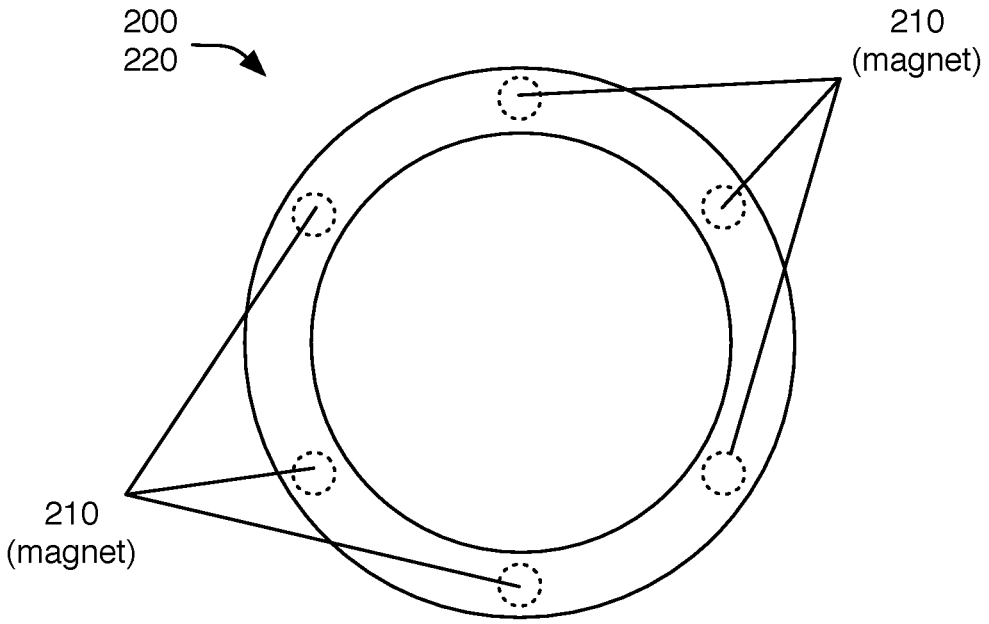
Figure 11:
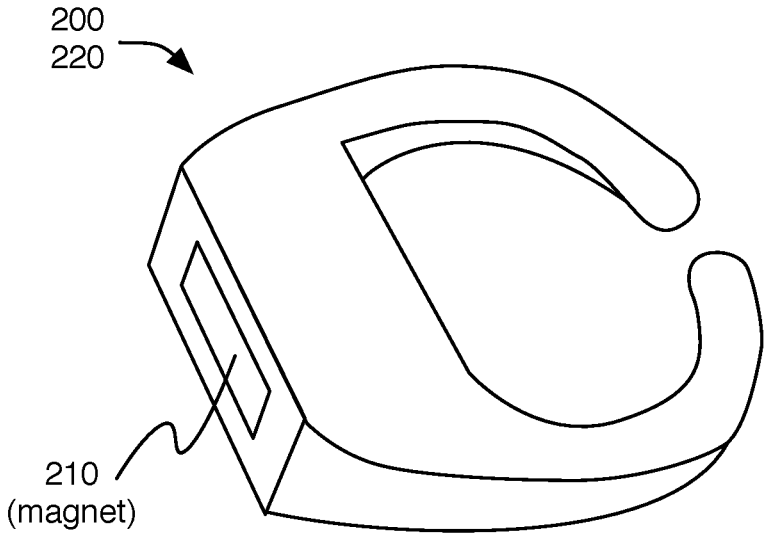
FIG. 11 is a perspective view of a fourth example of the control device.

In a second variation, the housing 220 is configured to be worn by the user (e.g., as shown in FIGS. 10-11). In a first example of this variation, the housing 220 is a piece of jewelry (e.g., ring, necklace, bracelet, jewelry to be worn in a body piercing, etc.). In a second example, the housing 220 is clothing (e.g., bra, underpants, belt buckle, blindfold, etc.). In a third example, the housing 220 includes a surface attachment mechanism (e.g., adhesive material, suction cup, skin clamp, etc.) configured to attach the control device 200 to the user. In a fourth example, the housing 220 is configured to be retained by clothing. In a fifth example, the housing 220 is configured to encircle a body part of the user (e.g., includes straps configured to encircle the body part, includes a flexible material configured to encircle and retain the housing 220 against the body part, etc.), such as a penis, finger, wrist, or neck. In a sixth example, the housing 220 includes an extended region configured to be inserted into a body cavity. However, the housing 220 can otherwise be operable to couple the excitation device 100 to the user, or can optionally not function to couple the excitation device 100 to the user.

The housing 220 can optionally include one or more input regions, which can function to receive control inputs from a user. The input regions can be the same as or different from the excitation device input regions 153. For example, the input regions can be used to control the control device operation (e.g., by providing control signals to a control device processor, by establishing and/or disconnecting an electrical connection between the outputs 210 and a control device power module, etc.), such as powering on and/or off the control device 200 and/or altering the signal intensity from the outputs 210. However, the input regions can additionally or alternatively function in any other suitable manner.

The housing 220 can have the same shape and/or material (s) as the excitation device housing 150, or can have a different shape and/or material(s). In one variation, the control device housing 220 and excitation device housing 150 are substantially identical (e.g., both configured to mechanically couple to a user's vulva) and house substantially identical stimulation units (e.g., both house 3 vibratory actuators). In one example of this variation, the excitation device 100 is configured to transmit information (e.g., control signals) to the control device 200, enabling the control device to control its stimulation units in a similar (e.g., substantially identical and/or concurrent) manner to the excitation device stimulation units (e.g., while each device is mechanically coupled to a different user). However, the control device 200 can additionally or alternatively include any other suitable component(s) and/or be configured to operate in any other suitable manner.

4. Method.

A method 300 for sexual stimulation preferably includes sampling measurements S330, determining actuation parameters S340, and actuating stimulation units S350. The method 300 can optionally include coupling devices to one or more users S310, generating signals S320, and/or any other suitable processes.

The method 300 is preferably performed using the system 1 described above (e.g., using one or more excitation devices 100 and/or control devices 200 such as those described above), and can optionally include using all or some of the functionality of the elements of the system 1 (e.g., functionalities described above, such as those the elements of the system can function to perform, can be configured to perform, and/or can be operable to perform). For example, the method 300 can include operating the system (e.g., by the excitation device processor, by any other suitable control element) according to one or more of the modes described above regarding the processor (e.g., remote control modes, standby modes, off modes, predefined output modes, etc.). However, the method 300 can additionally or alternatively be performed by any other suitable systems.

The method 300 preferably function to provide stimulation (e.g., sexual stimulation) to a user (e.g., user coupled to the excitation device). The method 300 can optionally function to provide shared (e.g., simultaneous, similar, etc.) sensation to multiple users. For example, the method can be performed using multiple excitation and/or control devices, preferably coupled to different users (e.g., as described above regarding a system in which an excitation and control device are mechanically connected to each other), and/or can include transmitting information from the excitation device to another device, such as a control device including stimulation units and/or a second excitation device, thereby enabling actuation based on the shared information (e.g., as described above regarding the communication module). However, shared sensation can additionally or alternatively be achieved in any other suitable manner.

Coupling devices to users S310 can include coupling (e.g., mechanically) one or more devices (e.g., excitation devices, control devices, etc.) to one or more users (e.g., to one or more body parts of the users). The devices can be coupled to the user(s) as described above (e.g., regarding the system, such as regarding the excitation device and/or control device) and/or in any other suitable manner. Coupling an excitation device to a user preferably functions to enable stimulation of the user by the excitation device stimulation units. For example, S310 can include mechanically coupling vibratory elements of the excitation device to the user, such that vibrations from the vibratory elements are transmitted to the user. Coupling a control device to a user preferably functions to facilitate user control of the system. For example, coupling the control device to the user can allow the user to move the control device, and/or can cause the control device to move in response to user movements (e.g., move along with a body part of the user, move in opposition to such movements, etc.). In one embodiment, S310 includes coupling an excitation device to a first body part (e.g., to a genital region of a first user, such as to a clitoris, vulva, and/or vagina, a penis, an anus and/or rectum, etc.; to an erogenous region of the first user; etc.) and coupling a control device to a second body part (e.g., body part of the first user, of a second user near the first user, etc.; body part such as a hand, arm, face, male genitals, female genitals, etc.). However, S310 can additionally or alternatively include coupling any suitable number and/or type of devices to any suitable body parts of one or more users.

Generating signals S320 can function to generate signals associated with excitation device control (and/or any other suitable signals). The signals can be generated by the control device (e.g., as described above, such as regarding the control device outputs), and signal generation can be affected by control device manipulation (e.g., movement and/or spatial arrangement of the control device). In a first example, S320 includes placing one or more control devices (e.g., device including a magnet, such as a magnet with a North or South pole arranged pointing substantially toward a sensor of the excitation device) in one or more arrangements (e.g., relative to the excitation device), wherein the signals are generated by the control devices (e.g., while in the arrangements, at all times, etc.). In a second example, S320 includes moving the control device(s) along one or more paths, in one or more directions, at one or more speeds, and/or corresponding to one or more spatial and/or temporal patterns (e.g., patterns described above). In embodiments in which the control device(s) include one or more magnets, S320 can include the magnets generating magnetic fields (e.g., fields intrinsically generated by the magnets). S320 is preferably performed throughout performance of the method (e.g., continuously, periodically, sporadically, etc.), but can additionally or alternatively be performed during only a portion of the method, be performed only once, be performed in response to triggers (e.g., inputs received from a user, from the excitation device, from a remote computing system; triggers associated with measurements sampled by sensors of the control device and/or excitation device; etc.), and/or be performed with any other suitable timing. However, S320 can additionally or alternatively include any other suitable elements performed in any other suitable manner.

Sampling measurements S330 preferably includes sampling signals generated in S320, but can additionally or alternatively include sampling any other suitable measurements. The measurements are preferably sampled as described above (e.g., regarding the excitation device sensor, remote sensors, etc.), but can additionally or alternatively be sampled in any other suitable manner. The measurements are preferably sampled by the excitation device, but can additionally or alternatively be sampled by control devices, remote sensors, and/or any other suitable elements. S330 is preferably performed throughout performance of the method (e.g., continuously, periodically, sporadically, etc.), but can additionally or alternatively be performed during only a portion of the method, be performed only once, be performed in response to triggers (e.g., signal generation, such as during performance of 320, detection of generated signals, inputs received, triggers associated with measurements, etc.), and/or be performed with any other suitable timing.

In a first embodiment, S330 includes sampling (e.g., at an excitation device sensor) one or more measurements indicative of spatial information associated with the control device (s) and/or any other suitable objects, such as positions and/or orientations (e.g., relative to the excitation device; relative to an external reference, such as a gravity vector, geomagnetic field, nearby object, etc.), movements (e.g., speeds, directions of motion, direction changes, rotations, patterns followed, etc.), and/or any other suitable spatial information. For example, S330 can include determining (e.g., estimating, calculating, etc.) a direction (e.g., relative to internal and/or external reference axes) from the excitation device (e.g., from the sensor) to the control device (e.g., to the output) and/or a metric associated with distance between the excitation device and the control device. The metric can be a distance, a signal strength (e.g., field strength, such as magnetic or electric field strength; audio volume; light intensity; signal-to-noise ratio; etc.) such as a strength at (e.g., measured by) the sensor, a temperature (e.g., determined based on optical thermometry), a function (e.g., monotonic function, such as monotonically increasing or decreasing function, strictly increasing or decreasing function, weakly increasing or decreasing function, etc.) of the distance, signal strength, and/or temperature, and/or any other suitable metric.

In a first variation of this embodiment, the control device includes one or more magnets and/or the excitation device includes one or more magnetometers (e.g., 3-axis magnetometer, 1-axis magnetometer, etc.). In this variation, S330 includes sampling one or more magnetic measurements (e.g., magnetic field measurement including a magnetic field direction, overall strength, and/or strength along one or more directions, such as the axes of the magnetometer, etc.). The magnetic measurements preferably sample a magnetic field generated by the control devices or devices (e.g., field generated exclusively by the control device, total magnetic field including contributions from both the control device and other sources, total magnetic field excluding the geomagnetic field, etc.) and/or is preferably not a geomagnetic field (e.g., field attributable exclusively or substantially exclusively to the Earth's geomagnetic field, ambient magnetic field lacking substantial contribution from a control device, etc.), but can additionally or alternatively include any other suitable magnetic field(s).

In a second variation, the control device includes one or more elements of elevated and/or depressed temperature (e.g., relative to an ambient temperature, a default temperature such as 20° C. or 22° C., etc.), such as a heater element or human body part, and/or the excitation device includes a thermal sensor (e.g., optical thermometer, such as a single- or multi-color infrared sensor). In this variation, S330 includes sampling one or more temperature-related measurements (e.g., sampling the temperature of the control device and/or other nearby objects; determining presence, absence, and/or position of objects of elevated and/or depressed temperature; etc.). In an example of this variation, in which the excitation device includes a proximity sensor (e.g., optical rangefinder, radar, sonar, etc.), S330 can include determining distance (e.g., from the proximity sensor) to features detected by the thermal sensor (e.g., hot, cold, and/or ambient temperature objects, such as the control device). However, S330 can additionally or alternatively include sampling any other suitable measurements in any suitable manner.

Determining actuation parameters S340 can function to determine parameters for stimulation unit actuation. The actuation parameters are preferably determined based on the measurements sampled in S330 and/or based on the signals generated in S320, but can additionally or alternatively be determined in any other suitable manner. S340 is preferably performed throughout performance of the method (e.g., continuously, periodically, sporadically, etc.), such as performed in response to (e.g., immediately following, in response to receiving information indicative of the sampled measurements, etc.) performance of S330 (e.g., each iteration of S330; iterations of S330 in which the sampled measurements change from the previous iteration and/or other iterations, such as substantially changing or changing by more than a threshold absolute or relative amount; etc.). However, S330 can additionally or alternatively be performed during only a portion of the method, be performed only once, be performed in response to triggers, and/or be performed with any other suitable timing.

S340 preferably include selecting one or more stimulation units and determining actuation parameters (e.g., actuation type, actuation intensity, etc.) for each selected unit (or for all stimulation units of the excitation device or system or any other suitable subset of stimulation units). In one embodiment, S340 includes selecting the stimulation unit (or units) in an extremal position relative to the control device (e.g., actual control device position, position estimated based on the sampled measurements, etc.), such as the stimulation unit closest to and/or farthest from the control device position. In a first variation of this embodiment, proximity can be determined based on overall distance between the elements. In a second variation, proximity can be determined based on distance along one or more reference directions, such as distance between projections of the elements onto a reference plane or surface (e.g., broad face of the excitation device, plane defined by the stimulation units, etc.), radial, circumferential, and/or axial distance relative to a reference axis (e.g., central axis normal to the reference plane, axis of a cylinder on which the stimulation units are substantially arranged, etc.), and/or any other suitable distance metric.

In another embodiment, S340 includes determining a control vector (e.g., relative control device position; sampled vector, such as a magnetic field vector; vector with direction associated with a heading, such as a control device direction, and a length, such as a length proportional to the metric; etc.) based on the sampled measurements, preferably selecting the stimulation unit(s) based on the control vector (e.g., selecting the units most aligned with the control vector). For example, each stimulation unit can be associated with a location vector (e.g., vector from a reference origin point, such as an excitation device sensor and/or central point, to the stimulation unit), and the selected stimulation unit can have the location vector most aligned with the control vector. Vector alignment can be determined based on angular separation (e.g., total angle, angle along one or more directions, such as in-plane angle, etc.), maximum or minimum dot product and/or cross product, and/or any other suitable alignment metric.

The actuation intensity associated with the selected stimulation units (and/or other units) is preferably determined based on the metric, such as by a monotonic (e.g., increasing, decreasing) function of the metric. For example, smaller distance (e.g., between the excitation device and control device) and/or higher signal intensity can correspond to a higher actuation intensity, and larger distance and/or lower signal intensity can correspond to a lower actuation intensity. In a first specific example, a first actuation intensity for the selected stimulation unit is determined based on a function of the metric, and actuation intensity for the other stimulation units is determined based on the first actuation intensity (e.g., as a function of the first actuation intensity, proportional to the first actuation intensity, etc.), preferably such that the first actuation intensity is greater than the other intensities. In a second specific example, a respective actuation intensity is determined for each stimulation unit based on the function (e.g., using a separate metric associated with each stimulation unit to calculate the respective actuation intensity), such as determined based on the distance between a given stimulation unit and the control device.

The function can additionally or alternatively depend on the alignment between the location vector and control vector (e.g., angular separation, such as total angle or in-plane angle). For example, the actuation intensity can be determined based on a function of both the metric and the angular separation, wherein, for any fixed value of angular separation, the function is monotonic with respect to the metric, and/or for any fixed value of the metric, the function is monotonic with respect to the angular separation (e.g., sinusoidal function of the angular separation, such as a cardioid; step function, such as non-zero for small separations and zero for larger separations; etc.). In a specific example, the metric is a sampled measurement intensity (e.g., at the sensor, such as magnetic field strength at the magnetometer), and a respective actuation intensity for each stimulation unit is determined based on the metric and a respective angular separation, wherein a larger metric and/or smaller angular separation corresponds to a higher actuation intensity. The function can be linear, exponential, logarithmic, and/or have any other suitable properties.

Actuating stimulation units S350 can function to provide stimulation (e.g., sexual stimulation) to a user (e.g., user coupled to the excitation device). The stimulation units are preferably actuated based on the actuation parameters determined in S340, but can additionally or alternatively be actuated in any other suitable manner. S350 is preferably performed throughout performance of the method (e.g., continuously, periodically, sporadically, etc.), such as performed in response to (e.g., immediately following, in response to receiving information indicative of the sampled measurements, etc.) performance of S340, but can additionally or alternatively be performed during only a portion of the method, be performed only once, be performed in response to triggers, and/or be performed with any other suitable timing. S350 is preferably includes selectively controlling the power module to provide power to the stimulation units (e.g., as described above, such as regarding the processor and/or power module), but can additionally or alternatively be performed in any other suitable manner. For example, S350 can include controlling the stimulation units (e.g., vibratory actuators) to actuate at the respective actuation intensities determined in S340 (e.g., continuously controlling each stimulation unit to actuate at the most recently determined intensity associated with that stimulation unit). However, S350 can additionally or alternatively include actuating the stimulation units in any other suitable manner, and/or the method 300 can additionally or alternatively include any other suitable elements.

Although omitted for conciseness, the preferred embodiments include every combination and permutation of the various system components and the various method processes. Furthermore, various processes of the preferred method can be embodied and/or implemented at least in part as a machine configured to receive a computer-readable medium storing computer-readable instructions. The instructions are preferably executed by computer-executable components preferably integrated with the system. The computer-readable medium can be stored on any suitable computer readable media such as RAMs, ROMs, flash memory, EEPROMs, optical devices (CD or DVD), hard drives, floppy drives, or any suitable device. The computer-executable component is preferably a general or application specific processing subsystem, but any suitable dedicated hardware device or hardware/firmware combination device can additionally or alternatively execute the instructions.

The FIGURES illustrate the architecture, functionality and operation of possible implementations of systems, methods and computer program products according to preferred embodiments, example configurations, and variations thereof. In this regard, each block in the flowchart or block diagrams may represent a module, segment, step, or portion of code, which comprises one or more executable instructions for implementing the specified logical function(s). It should also be noted that, in some alternative implementations, the functions noted in the block can occur out of the order noted in the FIGURES. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

As a person skilled in the art will recognize from the previous detailed description and from the figures and claims, modifications and changes can be made to the preferred embodiments of the invention without departing from the scope of this invention defined in the following claims.

We claim:

1. A method for excitation device control, the method comprising:

coupling an excitation device, comprising a magnetometer and a plurality of haptic actuators, to a user, wherein each haptic actuator of the plurality is configured to provide haptic stimulus to the user;

arranging a control device in a first arrangement relative to the excitation device, the control device comprising a magnet;

at the excitation device, while the control device is arranged in the first arrangement, detecting a first magnetic field generated by the control device;

based on the first magnetic field, selecting a first haptic actuator from the plurality, wherein the first arrangement defines:

a first distance between the control device and the first haptic actuator; and a second distance, greater than the first distance, between the control device and a second haptic actuator;

based on a strength of the first magnetic field, determining a first intensity and a second intensity less than the first intensity; and in response to detecting the first magnetic field, controlling the plurality of haptic actuators based on the first magnetic field, comprising:

controlling the first haptic actuator to actuate at the first intensity; and controlling the second haptic actuator to actuate at the second intensity.

2. The method of claim 1, further comprising:

after controlling the plurality of haptic actuators based on the first magnetic field, arranging the control device in a second arrangement relative to the excitation device, wherein the second arrangement defines:

a third distance, less than the first distance, between the control device and the first haptic actuator; and a fourth distance, greater than the third distance, between the control device and the second haptic actuator;

at the excitation device, while the control device is arranged in the second arrangement, detecting a second magnetic field generated by the control device; and in response to detecting the second magnetic field, controlling the plurality of haptic actuators based on the second magnetic field, comprising:

controlling the first haptic actuator to actuate at third intensity greater than the first intensity; and controlling the second haptic actuator to actuate at a fourth intensity less than the third intensity.

3. A method for excitation device control, the excitation device comprising a sensor and a plurality of haptic actuators, the method comprising:

at the sensor, sampling a measurement indicative of a first position, relative to the excitation device, of a control device;

based on the measurement, selecting a first haptic actuator from the plurality, wherein, in the first position, the control device is closer to the first haptic actuator than to any other haptic actuator of the plurality;

based on the measurement, determining a first metric associated with a first distance between the excitation device and the control device in the first position;

based on the first metric, determining a first intensity;

in response to sampling the measurement, controlling the first haptic actuator to actuate at the first intensity; and substantially concurrent with controlling the first haptic actuator to actuate at the first intensity, controlling a second haptic actuator of the plurality to actuate at a second intensity less than the first intensity.

4. The method of claim 3, further comprising:

at the sensor, sampling a second measurement indicative of a second position, relative to the excitation device, of the control device;

based on the second measurement, selecting the first haptic actuator, wherein, in the second position, the control device is closer to the first haptic actuator than to any other haptic actuator of the plurality;

based on the second measurement, determining a second metric associated with a second distance between the excitation device and the control device in the second position, wherein the second distance is less than the first distance;

based on the second metric, determining a third intensity greater than the first intensity; and in response to sampling the measurement, controlling the first haptic actuator to actuate at the third intensity.

5. The method of claim 3, further comprising:

at the sensor, sampling a second measurement indicative of a second position, relative to the excitation device, of the control device;

based on the second measurement, selecting the second haptic actuator, wherein, in the second position, the control device is closer to the second haptic actuator than to any other haptic actuator of the plurality;

based on the second measurement, determining a second metric associated with a second distance between the excitation device and the control device in the second position;

based on the second metric, determining a third intensity and a fourth intensity greater than the third intensity; and in response to sampling the measurement:

controlling the first haptic actuator to actuate at the third intensity; and controlling the second haptic actuator to actuate at the fourth intensity.

6. The method of claim 3, wherein the excitation device further comprises a housing enclosing the plurality of haptic actuators, the housing comprising a bifurcated member configured to be retained within a vagina of the user, thereby retaining the first haptic actuator proximal a clitoris of the user.

7. The method of claim 3, wherein selecting the first haptic actuator based on the measurement comprises:

estimating the first position based on the measurement, comprising determining a direction associated with the first position; and selecting the first haptic actuator based on the direction.

8. The method of claim 3, wherein the sensor comprises a magnetometer and the measurement comprises a magnetometer measurement of a magnetic field.

9. The method of claim 3, wherein the first intensity is determined based on a monotonically decreasing function of the first distance.

10. The method of claim 3, further comprising, after controlling the first haptic actuator to actuate at the first intensity:

at the sensor, sampling a second measurement, the second measurement indicative of control device motion in a predetermined control pattern; and in response to sampling the second measurement, operating the excitation device in an alternate operation mode;

wherein, while operating the excitation device in the alternate operation mode, the first haptic actuator does not actuate at substantially the first intensity in response to the control device being arranged in the first position relative to the excitation device.

11. The method of claim 10, wherein, while operating the excitation device in the alternate operation mode, the plurality of haptic actuators do not actuate.

12. A method for excitation device control, the excitation device comprising a magnetometer and a plurality of haptic actuators, the method comprising:

at the magnetometer, sampling a measurement comprising a magnetic field direction and a first magnetic field strength;

based on the magnetic field direction, selecting a first haptic actuator from the plurality;

based on the measurement, determining a first intensity based on the magnetic field strength;

in response to sampling the measurement, controlling the first haptic actuator to actuate at the first intensity;

at the magnetometer, sampling a second measurement comprising a second magnetic field direction and a second magnetic field strength greater than the first magnetic field strength;

based on the second magnetic field direction, selecting the first haptic actuator;

based on the second measurement, determining a second intensity greater than the first intensity; and in response to sampling the second measurement, controlling the first haptic actuator to actuate at the second intensity.

13. The method of claim 12, further comprising, based on the measurement, estimating a magnet position relative to the excitation device, wherein the first haptic actuator is selected based on the magnet position, wherein the magnet position is closer to the first haptic actuator than to any other haptic actuator of the plurality.

14. The method of claim 12, further comprising, substantially concurrent with controlling the first haptic actuator to actuate at the first intensity, at a control device comprising a magnet and a control device haptic actuator distinct from the plurality of haptic actuators, controlling the control device haptic actuator to actuate at a third intensity.

15. The method of claim 14, further comprising, in response to sampling the measurement, transmitting a control signal from the excitation device to the control device, wherein the control device haptic actuator is controlled to actuate at the third intensity based on the control signal.

16. The method of claim 14, wherein the excitation device further comprises a second magnet and the control device further comprises a second magnetometer, the method further comprising:

substantially concurrent with sampling the measurement, sampling a third measurement at the second magnetometer, the third measurement comprising a third magnetic field direction and a third magnetic field strength; and determining the third intensity based on a monotonically increasing function of the third magnetic field strength;

wherein the control device haptic actuator is controlled to actuate at the third intensity in response to sampling the third measurement.

17. The method of claim 12, further comprising, substantially concurrent with controlling the first haptic actuator to actuate at the first intensity, controlling a second haptic actuator of the plurality to actuate at a third intensity less than the first intensity.

18. The method of claim 17, further comprising:

at the magnetometer, sampling a third measurement comprising a third magnetic field direction and a third magnetic field strength;

based on the third magnetic field direction, selecting the second haptic actuator;

based on the third measurement, determining a fourth intensity and a fifth intensity greater than the third fourth intensity; and in response to sampling the measurement:

controlling the first haptic actuator to actuate at the fourth intensity; and controlling the second haptic actuator to actuate at the fifth intensity.

* * * * *